US007396629B2

(12) United States Patent
Baba et al.

(10) Patent No.: US 7,396,629 B2
(45) Date of Patent: Jul. 8, 2008

(54) IMAGE FORMING METHOD AND IMAGE FORMING APPARATUS

(75) Inventors: Yoshinobu Baba, Yokohama (JP); Hiroyuki Fujikawa, Yokohama (JP); Nobuyoshi Sugahara, Toride (JP); Koh Ishigami, Mishima (JP); Naoki Okamoto, Mishima (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 11/114,058

(22) Filed: Apr. 26, 2005

(65) Prior Publication Data

US 2005/0244737 A1 Nov. 3, 2005

(30) Foreign Application Priority Data

Apr. 26, 2004 (JP) ..... 2004-130279

(51) Int. Cl.
*G03G 15/08* (2006.01)

(52) U.S. Cl. ..... 430/120.1; 430/58.05

(58) Field of Classification Search ..... 430/120, 430/58.05, 120.1

See application file for complete search history.

(56) References Cited

U.S. PATENT DOCUMENTS

| | | | | |
|---|---|---|---|---|
| 5,439,771 | A | 8/1995 | Baba et al. | 430/106.6 |
| 5,494,770 | A | 2/1996 | Baba et al. | 430/122 |
| 5,712,069 | A | 1/1998 | Baba et al. | 430/106.6 |
| 5,766,814 | A | 6/1998 | Baba et al. | 430/106.6 |
| 6,159,648 | A * | 12/2000 | Baba et al. | 430/110.4 |
| 6,562,530 | B2 * | 5/2003 | Morikawa et al. | 430/66 |
| 2005/0019684 | A1 * | 1/2005 | Sekiya et al. | 430/66 |

FOREIGN PATENT DOCUMENTS

| | | |
|---|---|---|
| JP | 5-216249 | 8/1993 |
| JP | 6-332237 | 12/1994 |
| JP | 7-72640 | 3/1995 |
| JP | 2003-345049 | 12/2003 |

* cited by examiner

*Primary Examiner*—John L Goodrow
(74) *Attorney, Agent, or Firm*—Fitzpatrick, Cella, Harper & Scinto

(57) ABSTRACT

An image forming method and an image forming apparatus are disclosed in which an electrostatic latent image is formed on a photosensitive member surface by using a two-component developer including a toner and carrier. The photosensitive member surface has a specific modulus of elastic deformation and includes a charge transport layer with a specific thickness. The toner has a specific weight-average particle diameter. The carrier has a specific volume-average particle diameter and a specific circularity, and contains 20% by number or less of particles having a value of "average circularity−2σ" where σ is standard deviation of carrier circularity.

12 Claims, 5 Drawing Sheets

FIG. 5

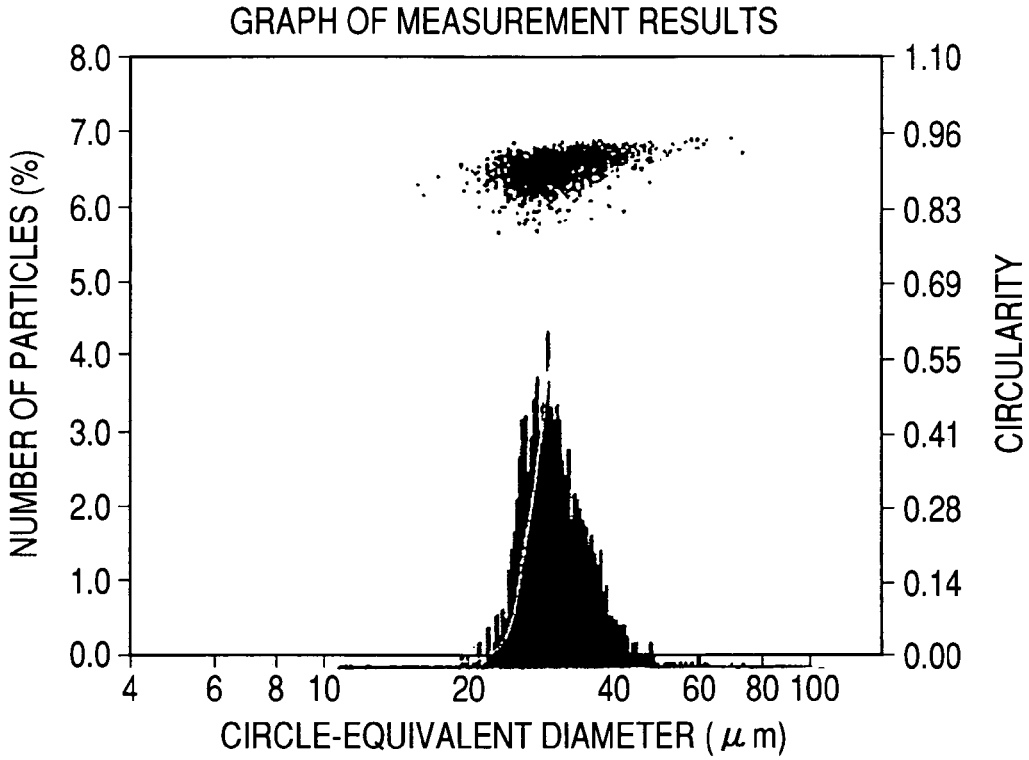

| CIRCLE-EQUIVALENT DIAMETER ARITHMETIC STATISTICS VALUES | |
|---|---|
| NUMBER OF PARTICLES | 1927 |
| IMAGE AVERAGE DIAMETER | 30.896 μm |
| DISTRIBUTION AVERAGE DIAMETER | 30.898 μm |
| 30% DIAMETER | 27.784 μm |
| 70% DIAMETER | 32.675 μm |
| 99% DIAMETER | 48.147 μm |
| HIGHEST FREQUENCY DIAMETER | 29.651 μm |
| STANDARD DEVIATION SD | 5.688 μm |
| COEFFICIENT VARIATION CV | 18.410% |

| CIRCULARITY ARITHMETIC STATISTICS VALUES | |
|---|---|
| NUMBER OF PARTICLES | 1927 |
| ARITHMETIC AVERAGE VALUE | 0.917 |
| 30% VALUE | 0.907 |
| 70% VALUE | 0.933 |
| 99% VALUE | 0.962 |
| STANDARD DEVIATION SD | 0.034 |
| COEFFICIENT VARIATION CV | 3.736% |

IMAGE FORMING METHOD AND IMAGE FORMING APPARATUS

BACKGROUND OF THE INVENTION

1. Field of the Invention

This invention relates to an image forming method and an image forming apparatus which make use of a two-component developer having a toner and a carrier, used in electrophotography or electrostatic recording and so forth, to develop an electrostatic latent image on a photosensitive member to form an image.

2. Related Background Art

In general, in image forming apparatus by which images are recorded on recording mediums such as paper, as in printers, an electrophotographic system is employed as a system by which the images are recorded on the recording mediums.

The electrophotographic system employs as an electrostatic latent image bearing member a photosensitive drum coated with a photosensitive material on its surface. First, the surface of the photosensitive drum is uniformly electrostatically charged, and thereafter the surface of the photosensitive drum is exposed to laser light, so that a potential difference is given between exposed areas and unexposed areas.

Next, using a developer having a toner and a carrier, a toner standing charged is made to adhere to the surface of the photosensitive drum in accordance with the potential difference to form a toner image on the surface of the photosensitive drum. Thereafter, the toner image is transferred to a recording medium, and then the toner image is fixed onto the recording medium by the action of heat and pressure or the like to form an image.

Recently, as reproduction equipment has attained higher image quality and higher speed, toners and photosensitive drums have been strongly required to achieve low running cost and so forth. As photosensitive drums used in the electrophotographic system, those having photosensitive layers smaller in thickness are used because of a necessity for high resolution. In addition thereto, it is attempted to improve electrical and mechanical strength or wear resistance of photosensitive drum surface because of a necessity for making the photosensitive drums have a longer lifetime for the achievement of low running cost.

As disclosed in Japanese Patent Application Laid-open Nos. H05-216249 and H07-072640, a proposal to use a curable resin in the surface layer is made in order to make the photosensitive member have higher resolution and higher durability. Where such a curable resin is used in the surface layer, compared with a thermoplastic resin, the surface layer can have a higher mechanical strength not to be easily abraded and also not to be easily scratched, and hence can have a longer lifetime. As also disclosed in Japanese Patent Application Laid-open No. 2003-345049, a method is proposed in which, in order to make the photosensitive member have higher durability inclusive of higher resolution as well, a surface layer that utilizes a variety of energy (such as heat, ultraviolet rays and electron rays) is formed on the surface of the photosensitive member (see Example 1). This brings about superior potential characteristics and image characteristics at the initial stage and also after running (comprehensive operation) even though thin films are formed which are 15 μm in layer thickness as the total of a photosensitive layer and the surface layer.

In such a thin-film photosensitive member, compared with thick-film photosensitive members, latent images which are sharp and have a high electric-charge density are formed when the same images are tried to be formed. Where such latent images are developed, sharper images are formed, desirably. However, in characteristics of photosensitive member potential and image density, the electric-charge density comes higher in inverse proportion to the layer thickness of the photosensitive member, and hence, in order to fill such electric charges with the toner, the toner becomes larger in quantity in inverse proportion to the layer thickness of the photosensitive member. That is, the γ curve may inevitably have a sharp slant (for example, if the layer thickness of the photosensitive member is half, the electric-charge density that is necessary to obtain a certain potential doubles. In order to fill such electric charges with the toner, the toner doubles in its quantity. In other words, the image density may abruptly vary with respect to the variations of contrast potential). Where such a photosensitive member is used, very clear images are obtainable in black-and-white copying machines or printers. However, in full-color copying machines or printers, which are required to provide high image quality for halftone, problems may arise such that it is difficult to reproduce the halftone because the γ curve has a sharp slant in the halftone region, and that image density varies greatly because of a slight variation in potential to make it difficult to reproduce colors. Also, in the thin-film photosensitive member, the potential of contrast tends to be so small that the above tendency is apt to be more remarkable.

Meanwhile, as disclosed in Japanese Patent Application Laid-open No. H06-332237, an approach is made from developers in order to achieve a higher image quality. What is proposed therein is that, for the achievement of a higher image quality, a toner is made to have small particle diameter and its particle size distribution is specified and further a carrier is made to have small particle diameter and its shape is specified, to achieve superior fluidity and superior resolution, gradation and fine-line reproducibility. Making toners and carriers have smaller particle diameter is very effective in making image quality higher. However, in the case when the thin-film photosensitive member as stated above is used, which has a high resolution but has a sharp slant in the γ curve, it is necessary for the toner to have a very large charge quantity in order to make the gradation high, and developing performance, i.e., what is called "toner release" from carrier, is not sufficiently satisfied in some cases. Also, if the toner has a large charge quantity, counter charges are liable to be collected in the carrier to cause carrier adhesion. On such an occasion, if the carrier has an amorphous particle shape, the photosensitive drum tends to be finely scratched at its surface even when it has a tough protective layer, so that the surface of the photosensitive drum may become matte with progress of running to cause coarse images or lines at halftone areas.

SUMMARY OF THE INVENTION

An object of the present invention is to provide an image forming method and an image forming apparatus which have solved such problems as discussed above.

More specifically, an object of the present invention is to provide an image forming method and an image forming apparatus which are able, in a system making use of a high-resolution thin-film photosensitive member, to obtain images with high gradation (high contrast) and high image quality, also prevent carrier adhesion, and reproduce stable images over a long period of time.

Another object of the present invention is to provide an image forming method and an image forming apparatus which are able to reproduce high-quality images with high image density where coarse images in halftone are kept from being caused at the initial stage and even after running.

That is, the present invention is to allow a toner to be held on a carrier in a large quantity by controlling the hardness and modulus of elastic deformation of the photosensitive member surface and the layer thickness of a charge transport layer and, in addition thereto, controlling the particle shape of the toner and the particle shape distribution of the carrier, to achieve high gradation and halftone reproducibility, also achieve the prevention of carrier adhesion and still also achieve the formation of stable images over a long period of time without causing any fine scratches on the photosensitive member surface.

In a first embodiment, the present invention is an image forming method comprising at least:

a step for forming an electrostatic latent image on a photosensitive member having at least a charge generation layer, and a charge transport layer on a conductive support and a step for developing the electrostatic latent image by the use of a two-component developer having a toner and a carrier, wherein;

the photosensitive member has a surface having a modulus of elastic deformation of from 46% to 65% and a universal hardness value HU of from $1.5\times10^8$ N/m$^2$ to $2.3\times10^8$ N/m$^2$, and the charge transport layer has a layer thickness of from 8 μm to 20 μm;

the toner has a weight-average particle diameter D4 of from 3.0 μm to 10.0 μm;

the carrier has a volume-average particle diameter Dv of from 15.0 μm to 60.0 μm and an average circularity C of from 0.830 to 0.950, and contains 20% by number or less of particles having a value of (average circularity C−2σ) or less where σ is standard deviation of carrier circularity.

In a second embodiment, the present invention is characterized in that, in order to improve toner release from carrier even where the toner is endowed with a high chargeability and also to prevent carrier adhesion, a carrier is used whose particle surfaces have been coated with a resin containing at least one of a silicone resin and a fluorine resin.

In a third embodiment, the present invention is characterized in that, in order for the toner to be held on the carrier in a large quantity, to improve halftone reproducibility and to obtain images with high image quality, a carrier is used which is a magnetic material dispersed resin carrier including a magnetic material and a binder resin, and the carrier has a true specific gravity of from 3.0 g/cm$^3$ to 4.0 g/cm$^3$ and an intensity of magnetization per carrier volume under 79.6 kA/m, of from 80 kAm$^2$/m$^3$ to 250 kAm$^2$/m$^3$ (emu/g·g/cm$^3$=emu/cm$^3$) In a fourth embodiment, the present invention is characterized in that, in order to obtain images with higher image quality, a toner is used which has a weight-average particle diameter of from 4.0 μm to 8.0 μm and an average circularity of from 0.920 to 1.000.

In a fifth embodiment, the present invention is characterized in that, in order to obtain images with higher image quality, a charge transport layer is used which has a layer thickness of from 8.0 μm to 16.0 μm.

In a sixth embodiment, the present invention is characterized in that, in order to have appropriate surface hardness and modulus of elasticity, prevent abrasion (wear) and fine scratches (matte surface) from being caused and obtain stable images over a long period of time, an photosensitive member is used in which the charge transport layer is divided into a first charge transport layer and a second charge transport layer, where the first charge transport layer is a layer formed of a binder resin in which a charge-transporting material has been dispersed, and the second charge transport layer is a layer which forms a surface layer and is formed of a curable resin obtained by polymerizing a compound having a polymerizable functional group represented by the following structural formula (1):

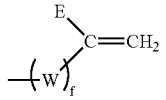

(1)

wherein E represents a hydrogen atom, a halogen atom, a substituted or unsubstituted alkyl group, a substituted or unsubstituted aryl group, a cyano group, a nitro group, an alkoxyl group, —COOR$_1$ (R$_1$ represents a hydrogen atom, a halogen atom, a substituted or unsubstituted alkyl group, a substituted or unsubstituted aralkyl group or a substituted or unsubstituted aryl group), —CONR$_2$R$_3$ (R$_2$ and R$_3$ each represent a hydrogen atom, a halogen atom, a substituted or unsubstituted alkyl group, a substituted or unsubstituted aralkyl group or a substituted or unsubstituted aryl group, and may be the same or different from each other); W represents a substituted or unsubstituted divalent arylene group, a substituted or unsubstituted divalent alkylene group, —COO—, —C—, —O—, —OO—, —S— or —CONR$_4$ (R$_4$ represents a hydrogen atom, a halogen atom, a substituted or unsubstituted alkyl group, a substituted or unsubstituted aralkyl group or a substituted or unsubstituted aryl group); and f represents an integer of 0 or 1.

BRIEF DESCRIPTION OF THE DRAWINGS

FIG. 5 is a graph showing the results of measurement of particle size distribution and circularity of the carrier used in the present invention. The left axis shows number-based particle size frequencies (%), which are displayed by a bar graph. The right axis shows circularities, which are displayed by dots.

DESCRIPTION OF THE PREFERRED EMBODIMENTS

The present inventors have made extensive studies on image forming methods making use of thin-film photosensitive members. As a result, they have found that, where a thin-film photosensitive member is used and development is performed using a two-component developer, the particle shape of a carrier influences the degree of carrier adhesion and also, as the particle shape of a carrier causative of carrier adhesion is more irregular and non-uniform, the photosensitive member surface is further finely scratched to make the photosensitive member surface become matte. Accordingly, it has been discovered that the thin-film photosensitive member may be made to have a surface protective layer and the surface protective layer may be made to have a specific modulus of elasticity so that both the prevention of the photosensitive member surface from abrading and the elastic force that relieves the stress on rubbing friction can be achieved to accomplish a surface which can not easily be scratched, and also that, as an approach from the carrier, the particle shape distribution of the carrier may be controlled so that the level of carrier adhesion can be reduced and at the same time, any scratches may not be caused. Further, where development is performed on a photosensitive member having a high electrostatic capacity as in the thin-film photosensitive member, the toner may be unnecessarily involved in development if the toner has a small charge quantity, and if it is attempted to perform development in a proper toner quantity, no contrast potential may be established to make it impossible to assure gradation. If the toner is made to have a large charge quantity, the toner release from carrier, i.e., the developing performance may lower to make it impossible to achieve the desired image density. Accordingly, it has been discovered that the particle diameter of the toner is controlled and the particle shape of the carrier is controlled so that the toner release from carrier can be improved even when the toner is allowed to have a large charge quantity.

The above situation will be described below in detail.

An example of the image forming method of the present invention is described with reference to FIG. 1. It should be construed that the present invention is by no means limited to the following image forming method and image forming apparatus.

Figure 1:
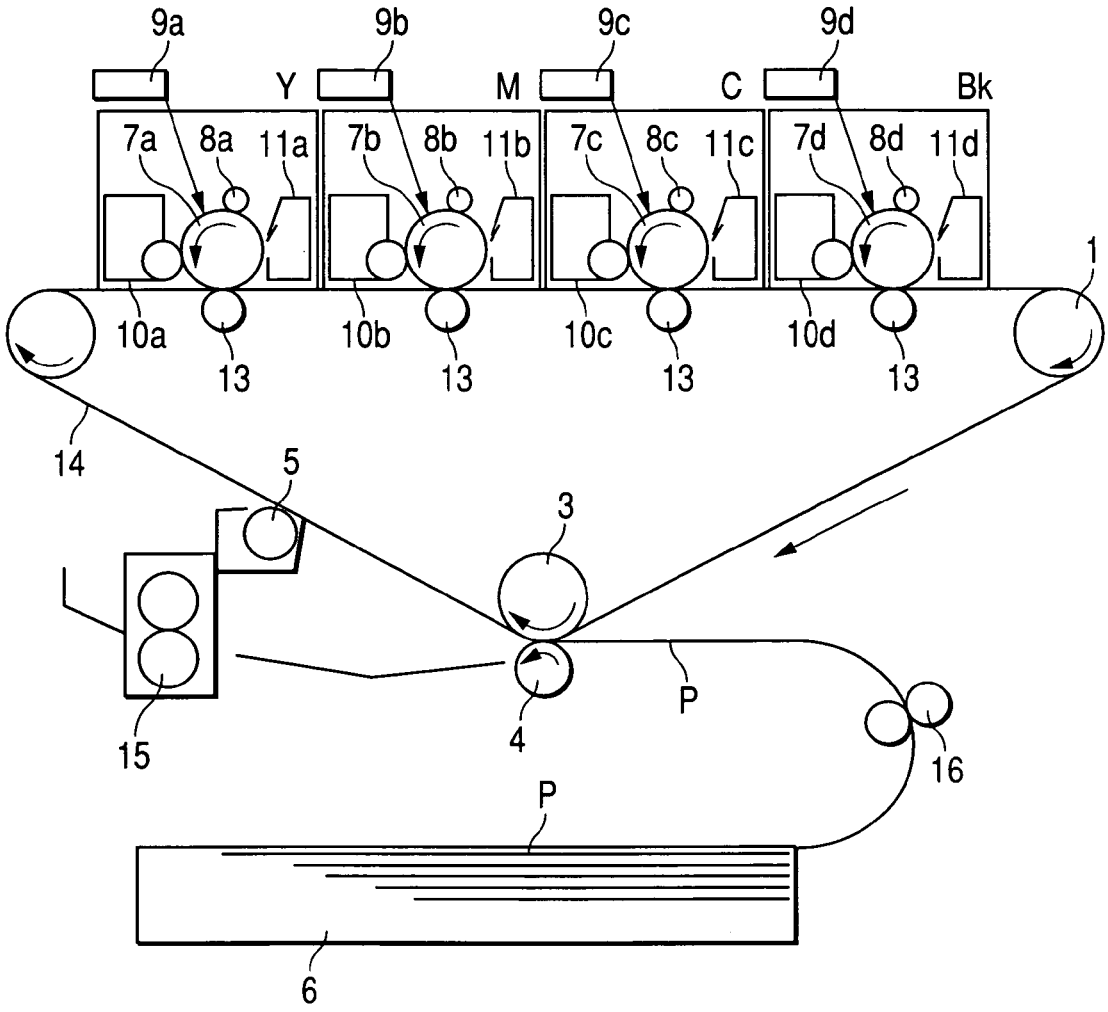
FIG. 1 is a schematic sectional view showing an example of the image forming apparatus of the present invention.

The image forming apparatus shown in FIG. 1 is an apparatus which forms color images by the use of two or more toners having different colors. It forms images through at least (I) a charging step which charges the photosensitive member surface electrostatically, (II) a latent image forming step of sequentially forming, on the photosensitive member thus charged, electrostatic latent images corresponding to the respective colors, (III) a developing step of visualizing the electrostatic latent images thus formed on the photosensitive member, by the use of toners of corresponding colors, (IV) a transfer step of transferring the respective-color toner images formed as visible images in the developing step to a transfer material and (V) a fixing step of fixing the toner images formed on the transfer material in the transfer step, by the action of heat and pressure or the like.

In such an image forming method, the developing step utilizes developing containers (10*a* to 10*d*) having plural developing assemblies corresponding to the respective-color toners, having developing rollers holding thereon two-component developers, and transfers the developers held on the developing rollers of the respective developing containers to photosensitive members (7*a* to 7*d*) by the aid of an electric field (used preferably by superimposing an AC electric field on a DC electric field), and develops the electrostatic latent images formed on the photosensitive members to sequentially form respective-color toner images on the photosensitive members. The amount of the developers held on the developing rollers may preferably be from 0.2 to 0.6 kg/m$^2$. The distance between each developing roller and each photosensitive member may be from 200 to 500 μm; this is preferable in order for a developer magnetic brush and the photosensitive member to form a good contact state. Also, contrast potential may be set at 200 to 450 V and, as development bias, an AC component having a Vp-p (peak-to-peak voltage) of from 400 to 2,500 V and a frequency of from 1.0 to 3.0 kHz (duty may be changed as needed) in approximation may be applied in addition to a DC component; this is favorable in order to achieve high image quality and high gradation.

Reference numeral 7*a* denotes a drum-shaped photosensitive member as an image bearing member, and is rotatively driven at a stated peripheral speed (process speed) in the direction of an arrow shown in the drawing. The photosensitive member 7*a* is first uniformly electrostatically charged to a stated potential by means of a charging assembly 8*a* (the charging step), and subsequently subjected to exposure by means of an exposure unit designated by 9*a* (the latent image forming step). In this way, an electrostatic latent image is formed corresponding to a first-color component image (e.g., yellow toner image) of an intended color image.

Subsequently, this electrostatic latent image is developed by means of a first developing assembly (e.g., yellow toner developing assembly 10*a*) to form a first-color toner image (e.g., yellow toner image). Electrostatic latent images are sequentially developed by means of second to fourth developing assemblies (i.e., a magenta toner developing assembly 10*b*, a cyan toner developing assembly 10*c* and a black toner developing assembly 10*d* (the developing step).

The toner images having been formed on the photosensitive members in the above developing step are subjected to the transfer step. The transfer step used in the image forming method of the present invention may consist of, as shown in FIG. 1, a primary transfer step which forms on an intermediate transfer member the color toner images to be formed on the transfer material, by sequentially transferring and superimposing onto the intermediate transfer member the respective-color toner images having been formed on the photosensitive member, and a secondary transfer step which transfers to the transfer material the respective-color toner images formed on the intermediate transfer member.

In what is shown in FIG. 1, an intermediate transfer belt 14 as the intermediate transfer member is rotatively driven at the same peripheral speed as that of the photosensitive members (7*a* to 7*d*) in the direction of an arrow. The first-color (e.g., yellow) toner image formed on the photosensitive member 7*a* is, in the course of passing through a contact zone between the photosensitive member 7*a* and the intermediate transfer belt 14, successively transferred onto the periphery of the intermediate transfer belt 14 by the aid of an electric field formed by a primary transfer bias applied to the intermediate transfer belt 14 through a primary transfer roller 13*a*. The surface of the photosensitive member 7*a* from which the first-color toner image has been transferred to the intermediate transfer belt 14 is cleaned by means of a cleaning unit 11*a*. Stations for other colors (magenta, cyan and black) are operated in the same manner. Thus, the respective-color toner images are superimposed and formed on the intermediate transfer belt 14.

Next, the respective-color toner images superimposed and formed on the intermediate transfer belt 14 are transferred to the transfer medium. Reference numeral 4 denotes a secondary transfer roller, which is so provided as to be axially supported in parallel to a secondary transfer opposing roller 3 in the state the former is separable from an undersurface portion of the intermediate transfer belt 14.

As the primary transfer bias applied to transfer the toner images from the photosensitive members to the intermediate transfer belt 14, a bias having a polarity reverse to that of the toner is applied. Its applied voltage may be in the range of, e.g., from +100 V to +200 V.

A transfer material-P held in a paper feed tray 6 is passed through a paper feed roller 16 and fed at given timing to a contact zone between the intermediate transfer belt 14 and the secondary transfer roller 4. At this point, a secondary transfer bias is applied to the secondary transfer roller 4, whereby the respective-color toner images having been transferred to the intermediate transfer belt 14 are secondarily transferred to the transfer material P. The transfer material P to which the respective-color toner images have been transferred is led to a fixing assembly 15, where the toner images are heated and fixed to form the intended color image.

After the toner images have been transferred to the transfer material P, the toners remaining on the intermediate transfer belt 14 (transfer residual toners) are scraped off by means of a belt cleaning unit 5, and then carried to a waste toner box.

The carrier in the present invention must have a volume-average particle diameter (Dv) of from 15.0 μm to 60.0 μm. Carrier particles having a volume-average particle diameter of less than 15.0 μm tend to have an amorphous shape and, even if their shape is substantially spherical, tend to cause carrier adhesion, so that the photosensitive member may finely be scratched. If the carrier has a volume-average particle diameter of more than 60.0 μm, it may be unable for the toner to be sufficiently charged, and also the developer magnetic brush tends to be rigid, and hence non-uniform sweep marks may appear or no good images are obtainable in some cases. More preferably, the carrier may have a volume-average particle diameter of from 20.0 μm to 40.0 μm to ensure high image quality and superior running stability.

The carrier in the present invention has an average circularity C of from 0.830 to 0.950, and preferably from 0.870 to 0.940. The average circularity is a coefficient which represents the roundness of the particle shape, and is determined from the maximum diameter of particles and the projected particle areas as measured. As the numerical value is closer to 1.000, the particles are more spherical. The smaller the numerical value is, the more slender or the more amorphous the particles tend to be. The carrier in the present invention has a shape that diverges form the spherical shape to a certain extent, and the circularity distribution is so controlled as to concentrate in a narrow range so that the carrier contains 20% by number or less of particles having a value of (average circularity $C-2\sigma$) or less ($\sigma$ is standard deviation of carrier circularity). Such a carrier has a superior charge-providing performance to the toner and also can not easily cause carrier adhesion, and, even if carrier adhesion occurs, the photosensitive member surface can be kept from being scratched. More preferably, the carrier may contain 15% by number or less of the particles having a value of (average circularity $C-2\sigma$) or less. This is favorable because the toner can be more uniformly charged in the case of charging in a high level and the toner release from carrier can be improved.

The carrier in the present invention has an intensity of magnetization per carrier volume, of from 80 to 250 $kAm^2/m^3$ ($emu/g \cdot g/cm^3 = emu/cm^3$), and preferably from 100 to 210 $kAm^2/m^3$, as measured under application of a magnetic field of 79.6 kA/m. If the intensity of magnetization per carrier volume is less than 80 $kAm^2/m^3$, magnetic binding force to the sleeve is insufficient and, even if the particle shape is substantially spherical, carrier adhesion is apt to occur to scratch the photosensitive member in some cases. If the intensity of magnetization is more than 250 $kAm^2/m^3$, the developer magnetic brush tends to be rigid, and hence non-uniform sweep marks may appear. In addition, the intensity of magnetization per carrier volume is a value found when the true specific gravity of the carrier is multiplied by the intensity of magnetization ($Am^2/kg$) of the carrier.

The carrier in the present invention may preferably have a true specific gravity of from 3.0 to 4.0 $g/cm^3$, and more preferably from 3.2 to 3.8 $g/cm^3$. The carrier having the true specific gravity within this range is preferable because a load on the toner is reduced when the carrier and the toner are agitated and blended, and the toner-spent to the carrier can be prevented from occurring, so that the toner release from carrier can be suitably maintained over a long period of time, and also the carrier adhesion to photosensitive member can be prevented from occurring. In order for the carrier to have such a preferable true specific gravity, the carrier may preferably be a magnetic material dispersed resin carrier including a magnetic material and a binder resin.

The carrier in the present invention may preferably be a magnetic material dispersed resin carrier making use of carrier cores formed of a binder resin with a magnetic material dispersed therein. In particular, a magnetic material dispersed resin carrier may be used which makes use of carrier cores produced directly through a polymerization step. This is preferable also in order to increase the average circularity and concentrate the circularity distribution in a narrower range. The magnetic material to be used may have a number-average particle diameter of approximately from 80 nm to 800 nm, which is preferable in order to prevent the magnetic material from liberation and in order for the carrier to have a higher strength, and also in order for the particle shape of the carrier to become substantially spherical, and in order for the particle shape to increase uniformity.

As for the amount of the magnetic material to be used in the magnetic material dispersed resin carrier, the magnetic material may be contained in an amount of from 70 to 95% by weight, and preferably from 80 to 92% by weight, based on the weight of the carrier. This is preferable-in order for the carrier to have a small true specific gravity and secure its mechanical strength sufficiently. This is also preferable in order to reduce an amorphous carrier having a low circularity. Further, in order to change magnetic properties of the carrier, a non-magnetic inorganic compound may be mixed in magnetic material dispersed core particles in addition to the magnetic material. The non-magnetic inorganic compound may have a number-average particle diameter of approximately from 100 nm to 1,000 nm, which is preferable in the respect that the resistivity of the carrier can be easily controlled.

When used in combination with the non-magnetic inorganic compound, the magnetic material may be contained in an amount of 50% by weight or more based on the total weight of the magnetic material and non-magnetic inorganic compound. This is preferable in order to control the intensity of magnetization of the resin carrier and prevent the carrier adhesion from occurring.

In the magnetic material dispersed resin carrier, it is preferable that the magnetic material includes fine magnetite particles, or magnetic fine ferrite particles containing at least an iron element or a magnesium element, and in order to control the magnetic properties and true specific gravity of the carrier, it is more preferable that the non-magnetic inorganic compound includes fine particles of hematite ($\alpha$-$Fe_2O_3$).

The binder resin constituting the carrier cores may include vinyl resins, polyester resins, epoxy resins, phenol resins, urea resins, polyurethane resins, polyimide resins, cellulose resins and polyether resins, whose polymer chains have methylene units. Any of these resins may be used in the form of a mixture.

The vinyl monomer for forming the vinyl resin may include styrene; styrene derivatives such as o-methylstyrene, m-methylstyrene, p-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated diolefines such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid, and maleic acid half ester; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; and acrolein. One obtained by polymerization using one or two or more kinds selected from these is used as the vinyl resin.

As a method of producing the magnetic material dispersed resin carrier cores most preferably usable in the present invention, a method may be cited in which a monomer(s) for the binder resin and the magnetic material are mixed and the monomer(s) is/are polymerized to obtain the magnetic fine particle dispersed resin carrier core particles. Here, as the monomer used in polymerization, the following may be cited: the vinyl monomers described above; and besides bisphenols and epichlorohydrin, for forming epoxy resins; phenols and aldehydes, for forming phenol resins; ureas and aldehydes, for forming urea resins; and melamine and aldehydes. For example, as a method of producing magnetic material dispersed resin carrier core particles making use of a curable phenol resin, a method is available in which the magnetic material is put into an aqueous medium, and a phenol and an aldehyde are polymerized in this aqueous medium in the presence of a basic catalyst to obtain the magnetic material dispersed resin carrier core particles.

The phenol for forming the phenol resin may include, besides phenol itself, compounds having a phenolic hydroxyl group, as exemplified by alkylphenols such as m-cresol, p-tert-butylphenol, o-propylphenol, resorcinol and bisphenol A, and halogenated phenols the benzene nucleus or alkyl groups of which have been partly or totally substituted with a chlorine atom(s) or a bromine atom(s). In particular, phenol (hydroxybenzene) is more preferred.

The aldehyde may include formaldehyde in the form of either of formalin and paraldehyde, and furfural. In particular, formaldehyde is preferred.

The molar ratio of the aldehyde to the phenol may preferably be from 1.0 to 4.0, and particularly preferably from 1.2 to 3.0. If the molar ratio of the aldehyde to the phenol is less than 1.0, the particles may be difficult to form, or even if formed, the curing of-the resin may not proceed, and hence the particles formed tend to have a low strength. If on the other hand the molar ratio of the aldehyde to the phenol is more than 4.0, unreacted aldehydes remaining in the aqueous medium after the reaction tend to increase.

The basic catalyst used in condensation polymerization of the phenol and the aldehyde may include those used in producing usual resol type resins. Such a basic catalyst may include, e.g., ammonia water, hexamethyltetramine and dimethylamine, as well as alkylamines such as diethyltriamine and polyethyleneimine. The molar ratio of any of these basic catalysts to the phenol may preferably be from 0.02 to 0.30.

In the present invention, as one measure for obtaining a substantially spherical carrier having the average circularity of from 0.830 or more to 0.950 or less and also for reducing the variation of the circularity, it is important to control the level of dissolved oxygen at the time of polymerization initiation. The level of dissolved oxygen in the reaction medium at the time of polymerization initiation may preferably be 5.0 $g/m^3$ or less. An inert gas introduced into the reaction medium for the purpose of deaerating the dissolved oxygen during the polymerization reaction should be, from an industrial viewpoint, at least one selected from nitrogen gas, argon gas and helium gas.

The inert gas may be introduced at a flow rate of from 5% by volume/min to 100% by volume/min of the volume of the reaction vessel before the polymerization reaction and, during the polymerization reaction, may be introduced into the reaction medium at a flow rate of from 1% by volume/min to 20% by volume/min so that it can be introduced at a lower flow rate during the polymerization reaction than before the polymerization reaction. This can prevent fine particles from being formed, and such particles from being incorporated into normal particles to become irregular in shape. If the inert gas is introduced before the polymerization reaction at a flow rate of less than 5% by volume/min, dissolved oxygen cannot be efficiency purged. If the flow rate is more than 100% by volume/min, the evaporation of monomers and so forth may be accelerated, undesirably.

It is also important to set the gas flow rate lower during the polymerization reaction than before the polymerization reaction. If the inert gas is introduced during the polymerization reaction at a flow rate of more than 20% by volume/min based on the volume of the reaction vessel, the above fine particles tend to be formed. This is considered to be due to the fact that the reaction medium is vigorously stirred by the gas during the polymerization reaction. If on the other hand the flow rate is less than 1% by volume/min, the level of oxygen present at the interface between the reaction medium and the air may increase, tending to cause the formation of fine particles.

In order to obtain the magnetic material dispersed resin carrier core particles by polymerizing the monomer, it is further important to control the stirring blade peripheral speed to be from 1.0 to 3.5 m/sec. If the stirring blade peripheral speed is less than 1.0 m/sec., the force of disintegration of the particles during polymerization may be so weak as to tend to form amorphous particles. If it is more than 3.5 m/sec., fine particles are apt to be produced, and they may, e.g., coalesce one another or coalesce with particles having the desired particle diameters, tending to form amorphous particles.

As a resin with which carrier particle surfaces are to be coated, it is preferable to use an insulating resin. The insulating resin usable here may be either of a thermoplastic resin and a thermosetting resin. Such a resin which forms the surface coat may specifically include, e.g., as the thermoplastic resin, polystyrene, acrylic resins such as polymethyl methacrylate and a styrene-acrylate copolymer, a styrene-butadiene copolymer, an ethylene-vinyl acetate copolymer, polyvinyl chloride, polyvinyl acetate, polyvinylidene fluoride resins, fluorocarbon resins, perfluorocarbon resins, solvent-soluble perfluorocarbon resins, polyvinyl alcohol, polyvinyl acetal, polyvinyl pyrrolidone, petroleum resins, cellulose, cellulose derivatives such as cellulose acetate, cellulose nitrate, methyl cellulose, hydroxymethyl cellulose, hydroxyethyl cellulose and hydroxypropyl cellulose, novolak resins, low-molecular-weight polyethylene, saturated alkyl polyester resins, aromatic polyester resins such as polyethylene terephthalate, polybutylene terephthalate and polyarylate, polyamide resins, polyacetal resins, polycarbonate resins, polyether sulfone resins, polysulfone resins, polyphenylene sulfide resins, and polyether ketone resins.

The thermosetting resin may specifically include, e.g., phenolic resins, modified phenolic resins, maleic resins, alkyd resins, epoxy resins, acrylic resins, unsaturated polyesters obtained by polycondensation of maleic anhydride and terephthalic acid with a polyhydric alcohol, urea resins, melamine resins, urea-melamine resins, xylene resins, toluene resins, guanamine resins, melamine-guanamine resins, acetoguanamine resins, Glyptal resin, furan resins, silicone resins, polyimide resins, polyamide-imide resins, polyetherimide resins and polyurethane resins.

The above resins may each be used alone, or may be used in the form of a mixture of any of these. A thermoplastic resin mixed with curing agent is used to effect curing.

As a particularly preferred embodiment, it is favorable to use a resin coat material having a high charge-providing ability and higher release properties with respect to the toner.

Accordingly, the carrier core coating resin may preferably contain at least one of a silicone resin and a fluorine resin.

The silicone resin may preferably be used from the viewpoint of adhesion to cores and prevention of toner-spent.

The silicone resin may be used alone. In order for the coat layer to have a higher strength and to favorably control the charging state of the toner, it may preferably be used in combination with a coupling agent. Further, referring to the above coupling agent, at least part thereof may preferably be used as what is called a primer with which the carrier core surfaces are treated before they are coated with the resin. Such treatment of the carrier core surfaces with the coupling agent enables resin layers, which are subsequently formed from the coat material, to be formed in the state of higher close adhesion involving covalent bonding.

As the coupling agent, it is preferable to use an aminosilane. As a result, amino groups having positively charging performance can be introduced to the carrier particle surfaces, and the toner can be provided with high, negatively chargeable properties.

When coating the carrier particle surfaces with the coat resin, it is preferable to carry out the coating under a reduced pressure at a temperature of from 30 to 80° C.

The reason therefor is unclear, and is presumed to be as follows.

(1) Reaction proceeds appropriately at the stage of coating, and the carrier core surfaces are uniformly and smoothly coated with the coat material.

(2) In the step of baking, at least a treatment at a low temperature of 160° C. or less is possible, thereby enabling any excess cross-linking of the resin to be prevented, and providing the coat layers with a high durability.

A carrier coat resin further preferably usable in the present invention may specifically include fluorine resins including perfluoropolymers such as polyvinyl fluoride, polyvinylidene fluoride, polytrifluoroethylene and polyfluorochloroethylene, polytetrafluoroethylene, polyperfluoropropylene, a copolymer of vinylidene fluoride and an acrylic monomer, a copolymer of vinylidene fluoride and trifluorochloroethylene, a copolymer of tetrafluoroethylene and hexafluoropropylene, a copolymer of vinyl fluoride and vinylidene fluoride, and a copolymer of vinylidene fluoride and tetrafluoroethylene. In particular, a coat resin used most preferably in the present invention is a polymer or copolymer of an acrylate or methacrylate having a perfluoroalkyl unit represented by the following general formula (1):

$$CF_3\text{-}(CF_2)_m \tag{1}$$

wherein m represents an integer of 1 to 11.

Any of the coat resins described above may be used alone, or may be used in the form of a mixture. A thermoplastic resin mixed with a curing agent may be used to effect curing.

In the present invention, if m is 0, it is difficult for the coat resin to exhibit releasability, and if m is more than 11, the coat resin tends to precipitate from a solvent to make it difficult to obtain good coat films when coated. In order for the coat film to have good toner releasability and coat film-forming properties., it is more preferable that m is 5 to 9.

A coat resin having a unit represented by the following general formula (2) may also preferably be used, to impart superior adhesion to the carrier cores:

$$CF_3\text{-}(CF_2)_m\text{-}(CH_2)_n \tag{2}$$

wherein m represents an integer of 1 to 11, and n represents an integer of 1 to 10.

From the viewpoint of the toner release from carrier, a coat resin is further preferred having a unit represented by the following general formula (3) and an acrylate or methacrylate unit represented by the following general formula (4).

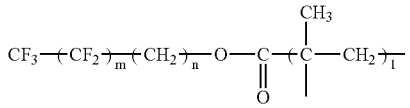

(3)

wherein m represents an integer of 1 to 11, n represents an integer of 1 to 10, and 1 represents an integer of 1 or more.

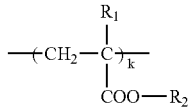

(4)

wherein $R_1$ represents a hydrogen atom or a methyl group, $R_2$ represents a hydrogen atom, an alkyl group having 1 to 20 carbon atoms or an aromatic group, and k represents an integer of 1 or more.

Further, since the properties of toner release can be maintained, it is particularly preferable to use a coat resin obtained by graft-copolymerizing the copolymer-units represented by the above general formulas (3) and (4) and a macromonomer such as methyl acrylate, ethyl acrylate, propyl acrylate, butyl or isobutyl acrylate, methyl methacrylate, ethyl methacrylate, propyl methacrylate and butyl or isobutyl methacrylate, having a molecular weight of approximately from 2,000 to 20,000.

The fluorine resin used as such a carrier coat resin may preferably have a main peak in the region of molecular weight of from 2,000 to 100,000 in a chromatogram of GPC of its THF-soluble component, and may more preferably have, in addition to the main peak, a sub-peak or a shoulder in the region of molecular weight of from 2,000 to 100,000. Most preferably, the fluorine resin that forms the coat resin may have, in the chromatogram of GPC of its THF-soluble component, a main peak in the region of molecular weight of from 20,000 to 100,000 and a sub-peak or a shoulder in the region of molecular weight of from 2,000 to 19,000. The feature that the coat resin satisfies the above molecular weight distribution brings about more improvement in a high charge-providing performance with respect to the toner.

The coat material may further preferably contain fine particles in a proportion of from 1 to 40 parts by weight based on 100 parts by weight of the coat resin. This is preferable in order to control fine unevenness of carrier particle surfaces and improve the toner release from carrier. As the fine particles, either of organic fine particles and inorganic fine particles may be used. However, the fine particles must retain the shape of particles when the carrier particles are coated with the coat resin. Accordingly, cross-linked fine resin particles or inorganic fine particles may preferably be used. Stated specifically, usable organic fine particles include fine particles of cross-linked polymethyl methacrylate resins, cross-linked polystyrene resins, melamine resins, phenol resins and nylon resins, and, as the inorganic fine particles, fine particles of silica, titanium oxide and alumina, any of which may be used alone or in the form of a mixture. In particular, fine cross-linked polymethyl methacrylate resin particles and fine melamine resin particles may be used alone or in the form of a mixture. This is preferable in order to achieve both of high charge-providing performance with respect to the toner and releasability from the toner.

The fine particles may have particle diameter having a number-based maximum peak value of from 100 nm to 500 nm, and more preferably from 150 nm to 400 nm. This is necessary in order to form fine unevenness of carrier particle surfaces and improve the toner release from carrier, while depending on the coating amount.

It is preferable that the fine particles are added in an amount of from 1 to 40 parts by weight based on 100 parts by weight of the coat resin and conductive particles are further incorporated in an amount of from 1 to 40 parts, in order for the carrier not to have too low resistivity and also in order to remove electric charges remaining on carrier particle surfaces and improve the toner release from carrier.

The conductive particles are preferred having a resistivity of $1\times10^8$ Ω·cm, and more preferably a resistivity of $1\times10^6$ Ω·cm. Stated specifically, the conductive particles may preferably be particles selected from carbon black particles, magnetite particles, graphite particles, zinc oxide particles and tin oxide particles. In particular, as particles having conductivity, carbon black is preferred because it has small particle diameter and is usable without impairing the unevenness attributable to fine particles on the carrier particle surfaces. The conductive particles may preferably have a particle diameter having a number-based maximum peak value of from 10 nm to 500 nm, and more preferably from 20 nm to 200 nm. This is preferable in order to remove electric charges remaining on the carrier particle surfaces and also to prevent the conductive particles from coming off from the carrier particles.

The carrier coat resin may be coated in an amount of from 0.3 to 4.0 parts by weight based on 100 parts by weight of the carrier core particles. This is preferable in order to provide a high charge and also in order for the charge quantity not to be changed due to environmental changes. If the amount is less than 0.3 part by weight, inferior charge-providing performance may result. If the amount is more than 4.0 parts by weight, it is difficult to achieve uniform coating, and charge-up may occur to cause carrier adhesion. In order to achieve good charge-providing performance and toner release from carrier, the amount of from 0.8 to 3.5 parts by weight is more preferable.

The carrier and toner used in the present invention may preferably be used in the state they are blended in such a form that their specific surface areas coincide with each other. The toner concentration may be approximately from 5% by weight to 20% by weight in the two-component developer. This is preferable from the viewpoint of charge-providing performance, prevention of fog, image density and so forth.

The toner used in the present invention has a weight-average particle diameter (D4) of from 3.0 μm to 10.0 μm, which may preferably be from 4.0 μm to 8.0 μm, and more preferably from 4.5 μm to 7.0 μm, in order to satisfy dot reproducibility and transfer efficiency. If the toner has a weight-average particle diameter of less than 3.0 μm, the toner has so large a specific surface area as to make it difficult to control charge quantity of individual toner particles, resulting in a low developing performance in some cases. If the toner has a weight-average particle diameter of more than 10.0 μm, the toner may be inferior in dot reproducibility, and can not readily have a charge quantity large enough to compensate electric charges the thin-film photosensitive member has, to cause a problem in achieving high image quality in some cases. The weight-average particle diameter of the toner may be controlled by regulating conditions for pulverization and classification of toner particles and conditions for granulation when the toner particles are produced.

The contact state between the toner and the carrier or between the toner and the photosensitive member may differ depending on whether the mode of contact is point-to-point or face-to-face contact. In such a case, the toner release from carrier is apt to become non-uniform, resulting in deterioration in developing performance. In order to prevent such deterioration from occurring, it is preferable for the toner to have an average circularity of from 0.920 to 1.000, more preferably from 0.930 to 1.000.

The toner in the present invention may be produced by conventionally known toner production processes such as kneading/pulverization, suspension polymerization and emulsion agglomeration. Taking low-temperature fixing performance into account, the toner may contain a polyester resin. For that purpose, the production process carried out by kneading/pulverization is preferably employed. In that case, the circularity may be controlled by the use of a specific surface modifying apparatus which brings the shape of toner particles (toner base particles) close to a spherical shape.

The apparatus which bring the toner particles close to a spherical shape may include, e.g., heat surface modifying apparatus such as Surfusion (manufactured by Nippon Pneumatic MFG Co., Ltd.), which makes particles spherical by melting their surfaces by heat, and a hot-air type sphering apparatus (manufactured-by Hosokawa Micron Corporation), and also including Hybridizer (manufactured by Nara Machinery Co., Ltd.), Turbo Mill (manufactured by Turbo Kogyo Co., Ltd.), Criptron (manufactured by Kawasaki Heavy Industries, Ltd.) and Mechanofusion System (manufactured by Hosokawa Micron Corporation), which makes particles spherical by mechanical impact surface modification.

Such sphering surface modification makes it easy to achieve high chargeability. When sphering toner particles containing a release agent, it is preferred to take into account the bleeding of the release agent to the toner particle surfaces. A more preferable apparatus capable of performing sphering surface modification to balance the degree of sphering and the bleeding of the release agent in the toner is specifically described with reference to the drawings.

Figure 2:
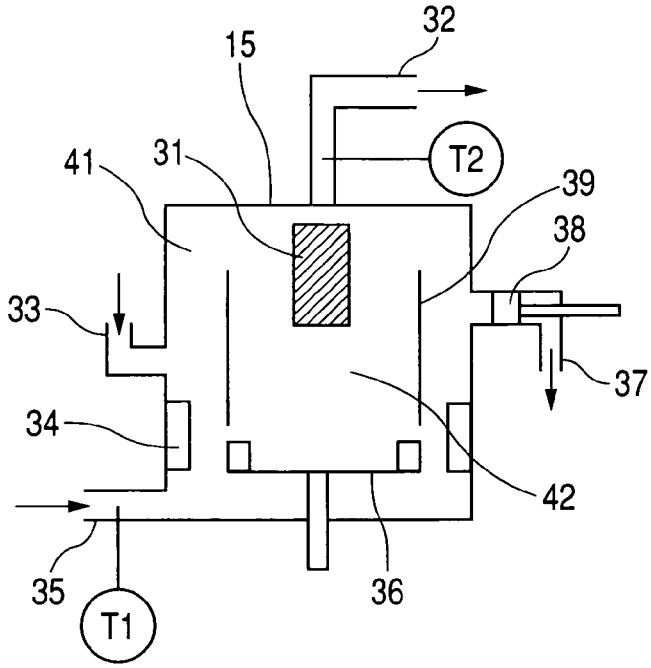
FIG. 2 is a schematic sectional view showing the construction of an example of a surface modifying apparatus used in the step of surface modification in producing the toner used in the present invention.

FIG. 2 illustrates an example of the surface modifying apparatus.

The surface modifying apparatus shown in FIG. 2 has a casing 45; a jacket (not shown) through which cooling water or an anti-freeze can be passed; a classifying rotor 31 which is a classifying means for classifying particles into those having particle diameters larger than stated ones and fine particles having particle diameters not larger than the stated ones; a dispersing rotor 36 which is a surface modifying means for applying mechanical impact to particles to carry out the surface modification of the particles; a liner 34 disposed along the dispersing rotor 36, keeping a stated clearance with respect to the outer periphery of the rotor; a guide cylinder 39 which is a guide means for guiding to the dispersing rotor 36 the particles having particle diameters larger than the stated ones among the particles classified by the classifying rotor 31; a fine-powder collecting discharge opening 32 which is a discharging means through which the fine particles having particle diameters not larger than the stated ones among the particles classified by the classifying rotor 31 are discharged to the outside of the apparatus; a cold air inlet 35 which is a particle circulating means by which the particles having been surface-modified by the dispersing rotor 36 are sent to the classifying rotor 31; a material feed opening 33 for introducing into the casing 15 the particles to be surface-modified; and a powder discharge opening 37 and a discharge valve 38 which are provided for discharging out of the casing 45 the particles having been surface-modified.

The classifying rotor 31 is a cylindrical rotor, and is provided on the top surface side in the casing 45. The fine-powder collecting discharge opening 32 is provided at the top of the casing 45 so that the particles inside the classifying rotor 31 can be discharged therethrough. The material feed opening 33 is provided at the middle of the peripheral wall of the casing 45. The cold air inlet 35 is provided on the bottom side of the peripheral wall of the casing 45, opposite to the top surface side on which the classifying rotor 31 is provided. The powder discharge opening 37 is provided in the peripheral wall of the casing 45 at its position set opposite to the material feed opening 33. The discharge valve 38 is a valve which opens or closes the powder discharge opening 37 as needed.

Figure 3:
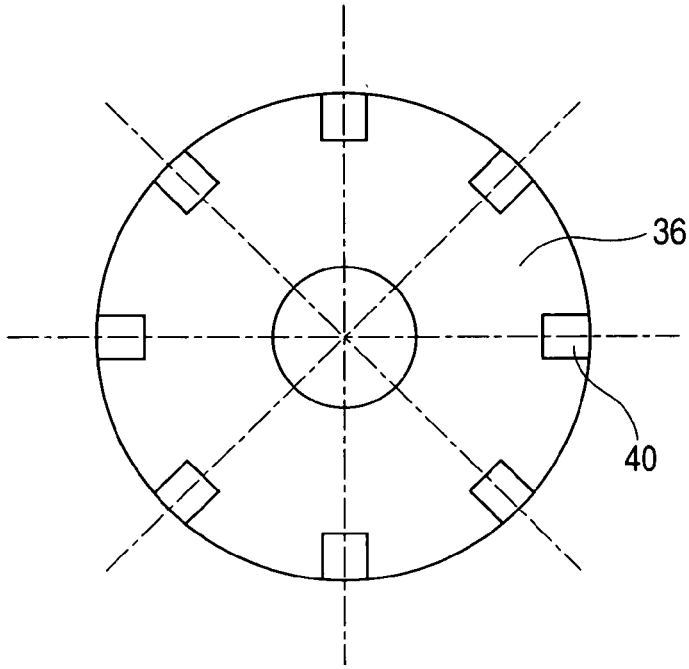
FIG. 3 is a schematic view showing an example of the top surface of a dispersing rotor shown in FIG. 2.

The dispersing rotor 36 and the liner 34 are provided between the cold air inlet 35, the material feed opening 33 and the powder discharge opening 37. The liner 34 is provided along the inner peripheral surface of the casing 45. The dispersing rotor 36 has, as shown in FIG. 3, a disk and, on the peripheral edge of this disk, a plurality of rectangular pins 40 disposed along the normal of the disk. The dispersing rotor 36 is provided on the bottom side of the casing 45, and is set at the position where a stated clearance is formed between the liner 34 and the rectangular pins 40. The guide cylinder 39 is provided at the middle of the casing 45. The guide cylinder 39 is a hollow cylindrical body, and is so provided as to extend from the position that partly covers the outer peripheral surface of the classifying rotor 31 up to the vicinity of the dispersing rotor 36. The guide cylinder 39 forms a first space 41 which is a space provided between the outer peripheral surface of the guide cylinder 39 and the inner peripheral surface of the casing 45 and a second space 42 which is a space inside the guide cylinder 39.

In addition, the dispersing rotor 36 may have cylindrical pins in place of the rectangular pins 40. The liner 34 is, in this embodiment, one provided with a large number of grooves in its surface set opposite to the rectangular pins 40. Alternatively, it may be one having no groove on that surface. Also, the classifying rotor 31 may be of a vertical type as shown in FIG. 2, or a lateral type. The classifying rotor 31 may also be provided alone as shown in FIG. 2, or in the plural number.

In the surface modifying apparatus constituted as described above, a finely pulverized product is introduced in a stated quantity through the material feed opening 33 in the state the discharge valve 38 is closed, whereupon the finely pulverized product introduced is sucked by a blower (not shown), and then classified by the classifying rotor 31. In that classification, the classified fine powder having particle diameters not larger than the stated ones passes the peripheral surface of the classifying rotor 31, is guided-to the inside of the classifying rotor 31, and is continuously discharged and removed out of the apparatus. Coarse powder having particle diameters not smaller than the stated ones rides on circulating flows generated by the dispersing rotor 36, along the inner periphery of the guide cylinder 39 (the second space 42) by the aid of centrifugal force, and is guided to a gap between the rectangular pins 40 and the liner 34 (hereinafter also "surface modification zone") The powder guided to the surface modification zone undergoes mechanical impact force between the dispersing rotor 36 and the liners 34, and is surface-modified. The surface-modified particles, having been subjected to surface modification, ride on the cold air passing through the interior of the apparatus, and is transported to the classifying rotor 31 along the outer periphery of the guide cylinder 39 (the first space 41), where fine powder is further discharged out of the apparatus by the action of the classifying rotor 31, and coarse powder, riding on the circulating flows, is returned again to the second space 42 to undergo surface modification action repeatedly in the surface modification zone. Thus, in the surface modifying apparatus shown in FIG. 2, the classification of particles by means of the classifying rotor 31 and the surface modification of particles by means of the dispersing rotor 36 are repeated. After a certain time passes, the discharge valve 38 is opened to collect the surface-modified particles through the discharge opening 37.

With such an apparatus, almost no bleeding of release agent due to heat occurs, and the sphering of toner particles and the control of the bleeding of release agent can be easily carried out, so that the toner can have a large charge quantity, very desirably.

In order for the toner in the present invention to have a high circularity, particles may be used which are obtained by direct polymerization or polymerization carried out in an aqueous medium, using a vinyl resin as the chief component. Where the toner has an average circularity of 0.960 or more, it may be easily applied to a cleanerless system.

In the toner used in the present invention, a toner is preferable which has a release agent so that the toner can be used in an oilless fixing system. Such a release agent may include aliphatic hydrocarbon waxes such as low-molecular weight polyethylene, low-molecular weight polypropylene, polyolefin copolymers, polyolefin wax, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax, montanate wax and behenyl behenate wax; and those obtained by subjecting part or the whole of fatty esters to deoxidizing treatment, such as deoxidized carnauba wax. It may further include saturated straight-chain fatty acids such as palmitic acid, stearic acid, stearic acid and montanic acid, as well as long-chain alkylcarboxylic acids having a further long-chain alkyl group; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol, as well as long-chain alkylcarboxylic acids having a further long-chain alkyl group; polyhydric alcohols such as sorbitol; fatty acid amides such as linolic acid amide, oleic acid amide and lauric acid amide; saturated fatty acid bisamides such as methylene bis(stearic acid amide), ethylene bis(capric acid amide), ethylene bis(lauric acid amide) and hexamethylene bis(stearic acid amide); unsaturated fatty acid amides such as ethylene bis(oleic acid amide), hexamethylene bis(oleic acid amide), N,N'-dioleyladipic acid amide and N,N'-dioleylsebasic acid amide; aromatic bisamides such as m-xylene bisstearic acid amide and N,N'-distearylisophthalic acid amide; fatty acid metal salts (those commonly called metal soap) such as calcium stearate, calcium laurate, zinc stearate and magnesium stearate; waxes grafted using vinyl monomers such as styrene and acrylic acid, to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The hydrocarbon waxes are preferred from the viewpoint of such an advantage that they have an appropriate compatibility with the binder resin and the release agent can finely be dispersed, and a toner may be preferably used having, in the endothermic curve as measured by differential thermal analysis, one or two or more endothermic peaks in the temperature range of from 30° C. to 200° C. and, in the endothermic peaks, a maximum endothermic peak temperature in the range of from 65° C. to 110° C. may preferably be used because it can improve low-temperature fixing performance and running performance.

The release agent used in the present invention may preferably be in a content of from 1 to 15 parts by weight, and more preferably from 3 to 10 parts by weight, based on 100 parts by weight of the binder resin. If it is in a content of less than 1 part by weight, it may come about that the releasability is not sufficiently brought about at the time of oilless fixing. If it is in a content of more than 15 parts by weight, the release agent tends to exude to toner particle surfaces, and may result in deterioration in developing performance (toner release from carrier) and transfer performance poor.

As the binder resin in the present invention, any of commercially available ones may be used. It is preferred to use a resin selected from (a) a polyester resin, (b) a hybrid resin having a polyester unit and a vinyl polymer unit, (c) a mixture of the hybrid resin and a vinyl polymer, (d) a mixture of a polyester resin and a vinyl polymer, (e) a mixture of the hybrid resin and a polyester resin, and (f) a mixture of a polyester resin, the hybrid resin and a vinyl polymer.

In the case where the polyester resin is used as the binder resin, a polyhydric alcohol and a polybasic carboxylic acid, or a polybasic carboxylic anhydride, a polybasic carboxylic ester and so forth are usable as raw-material monomers, The "polyester unit" in the hybrid resin indicates a moiety derived from polyester. As a polyester monomer which constitutes the polyester resin and the polyester unit, the following may be used: a polyhydric alcohol, a polybasic carboxylic acid and a polybasic carboxylic anhydride, or carboxylic acid components such as a polybasic carboxylic ester having two or more carboxyl groups.

Stated specifically, a dihydric alcohol component may include, for example, bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene (2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

A trihydric or higher alcohol component may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

The carboxylic acid component may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof.

As the polyester resin and the polyester unit, the following is particularly preferable: a polyester resin obtained by polycondensation of a bisphenol derivative represented by the following general formula as an alcohol component and a carboxylic acid component composed of a dibasic or higher carboxylic acid or an anhydride thereof or a lower alkyl ester thereof (e.g., fumaric acid, maleic acid, maleic anhydride, phthalic acid, terephthalic acid, trimellitic acid or pyromellitic acid) as an acid component, which can afford good charge characteristics as color toners.

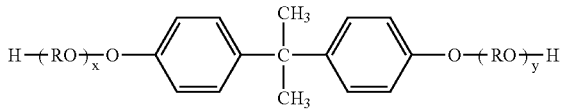

wherein R represents an ethylene group or a propylene group, x and y are each an integer of 1 or more, and the average value of x+y is 2 to 10.

A tribasic or higher carboxylic acid component for forming a polyester resin having cross-linked moieties and the polyester unit may include, e.g., 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these. The tribasic or higher carboxylic acid component may preferably be used in an amount of from 0.1 to 1.9 mol % based on the whole monomers.

A styrene monomer used in the vinyl resin and in the vinyl polymer unit may include styrene, o-methylstyrene, m-methylstyrene, p-methylstyrene, p-methoxylstyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyelene, p-n-octylstyrene, p-n-nonylstyrene, p-n-decylstyrene, p-n-dodecylstyrene, p-methoxystyrene and p-chlorostyrene.

An acrylic monomer may include acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate and phenyl acrylate, or acrylic acid and acrylic acid amides; and methacrylic esters such as ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate, or methacrylic acid and methacrylic acid amides. As a monomer for ethylene unsaturated monoolefins, it may include ethylene, propylene, butylene and isobutylene; as a monomer for vinyl esters, methyl vinyl ether, ethyl vinyl ether and isobutyl vinyl ether; as a monomer for vinyl ketones, methyl vinyl ketone, hexyl vinyl ketone and methyl isopropenyl ketone; as a monomer for N-vinyl compounds, N-vinylpyrrole, N-vinylcarbazole, N-vinylindole and N-vinylpyrrolidone; and as other monomer, vinylnaphthalenes, and acrylic acid or methacrylic acid derivatives such as acrylonitrile, methacrylonitrile and acrylamide. Any of these vinyl monomer may be used alone or in a combination of two or more.

A polymerization initiator used in producing the vinyl polymer may include, e.g., azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; peroxide type initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris-(t-butoxyperoxy)triazine; polymeric initiators having a peroxide in the side chain; persulfates such as potassium persulfate and ammonium persulfate; and hydrogen peroxide.

A radically polymerizable, trifunctional or higher polymerization initiator may include tris(t-butyl peroxy)triazine, vinyl tris(t-butyl peroxy)silane, 2,2-bis(4,4,d-t-butyl peroxycyclohexyl)propane, 2,2-bis(4,4,d-t-amyl peroxycyclohexyl) propane, 2,2-bis(4,4,d-t-octyl peroxycyclohexyl)propane, and 2,2-bis(4,4,d-t-butyl peroxycyclohexyl)butane.

In the toner used in the present invention, a known charge control agent may also be used in combination. Such a charge control agent is exemplified by organic metal complexes, metal salts and chelate compounds, which may include monoazo metal complexes, acetylyacetone metal complexes, hydroxycarboxylic acid metal complexes, polycarboxylic acid metal complexes, and polyol metal complexes. Besides, the charge control agent may also include carboxylic acid derivatives such as carboxylic acid metal salts, carboxylic anhydrides and carboxylic esters, and condensation products of aromatic compounds. As the charge control agent, phenolic derivatives such as bisphenols and carixarene can be used. In the present invention, it is preferable to use metal compounds of aromatic carboxylic acids, in order to improve start of charging.

In the present invention, the charge control agent may be contained in an amount of from 0.1 to 10 parts by weight, and more preferably from 0.2 to 5 parts by weight, based on 100 parts by weight of the binder resin. If it is in an amount of less than 0.1 part by weight, the toner may greatly change in charge quantity in environments of from high-temperature and high-humidity environment to low-temperature and low-humidity environment. If it is in an amount of more than 10 parts by weight, the toner may have a low charge quantity.

As colorants used in the present invention, known pigments and dyes may be used alone or in combination. For example, the dyes may include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6.

The pigments may include Mineral Fast Yellow, Navel Yellow, Naphthol Yellow S, Hanza Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, manganese violet, Fast Violet B, Methyl Violet Lake, cobalt blue, Alkali Blue Lake, Victoria Blue Lake, Phthalocyanine Blue, Fast Sky Blue, Indanthrene Blue BC, chromium green, Pigment Green B, Malachite Green Lake, and Final Yellow Green G. full-color images, Where the toner is used as toners for full-color image formation, color pigments for magenta toner may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; and C.I. Vat Red 1, 2, 10, 13, 15, 23, 29, 35.

Such pigments may be used alone. In view of image quality of full-color images, it is more preferable to use the dye and the pigment in combination so that the color sharpness can be improved.

Dyes for magenta may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Color pigments for cyan may include C.I. Pigment Blue 2, 3, 15:1, 15:2, 15:3, 16, 17; C.I. Vat Blue 6; C.I. Acid Blue 45; and copper phthalocyanine pigments the phthalocyanine skeleton of which has been substituted with 1 to 5 phthalimide methyl group(s).

Color pigments for yellow may include C.I. Pigment Yellow 1, 2, 3, 4, 5, 6, 7, 10, 11, 12, 13, 14, 15, 16, 17, 23, 65, 73, 74, 83, 93, 95, 97, 155, 180, 185; and C.I., Vat Yellow 1, 3, 20.

Pigments for black may include, e.g., carbon black such as furnace black, channel black, acetylene black, thermal black and lamp black. Magnetic powders such as magnetite and ferrite powders may also be used. It is preferable to use furnace black as having high coloring power and relatively high fastness.

In the case of the pigment, the colorant may be used in an amount of from 1 to 15 parts by weight, more preferably from 3 to 12 parts by weight, and still more preferably from 4 to 10 parts by weight, based on 100 parts by weight of the binder resin. If the colorant is in a content of more than 15 parts by weight, the transparency may lower, and besides, the reproducibility of halftone as typified by flesh color of humans also tends to lower. Moreover, the toner may be unstable in chargeability and also may be inferior in the toner to achieve low-temperature fixing performance. If the-colorant is in a content of less than 1 part by weight, the toner may be inferior in coloring power, and must be used in a large quantity in order to secure image density, tending to impair dot reproducibility and make it difficult to obtain high-grade images with high image density. In addtion, in the case where the magnetic powder is used as a black pigment, it may be used in an amount ranging from 5 to 20 parts by weight based on 100 parts by weight of the binder resin.

For the purpose of improving toner release from the carrier or photosensitive member and transfer performance, fine particles may externally be added to the toner in the present invention. As for external additives added externally to the surfaces of toner particles (toner base particles), one of them may be inorganic fine particles and may be at least one of fine titanium oxide particles, fine alumina particles and fine silica particles, and the inorganic fine particles may have an average particle diameter (a peak value of number distribution) of from 80 nm or more to 200 nm or less. This is preferable in order for the inorganic fine particles to function as spacer particles for improving the toner release from carrier. Also, as the external additives, fine particles having an average particle diameter (a peak value of number distribution) of 50 nm or less may preferably be used in combination. This is preferable in order to improve the chargeability and fluidity of the toner. Further, the inorganic fine particles may preferably be those having been subjected to hydrophobic treatment. The hydrophobic treatment may preferably be carried out using as a surface treating agent what is called a coupling agent such as titanium coupling agents or silane coupling agents of various types, a silicone oil, or the like.

As examples of the surface treating agent used in the hydrophobic treatment, the titanium coupling agent may include tetrabutyl titanate, tetraoctyl titanate, isopropyltriisostearoyl titanate, isopropyltridecylbenzenesulfonyl titanate, and bis(dioctyl pyrophosphate)oxyacetate titanate. Further, the silane coupling agent may include γ-(2-aminoethyl) aminopropyltrimethoxysilane, γ-(2-aminoethyl) aminopropyldimethoxysilane, γ-methacryloxypropyltrimethoxysilane, N-β-(N-vinylbenzylaminoethyl)-γ-aminopropyltrimethoxysilane hdyfrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane. The fatty acid may include long-chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linolic acid and arachidonic acid, and the metal salt thereof may include salts of metals such as zinc, iron, magnesium, aluminum, calcium, sodium and lithium. Further, as the surface treating agent, the following silicone oils may be cited: dimethylsilicone oil, methylphenylsilicone oil and amino-modified silicone oils.

Any of these surface treating agents may be applied-in an amount of from 1 to 10% by weight, and preferably from 3 to 7%, based on the weight of the inorganic fine particles. Also, any of these materials may be used in combination.

Concerning the degree of hydrophobic treatment, there is no particular limitation. Preferably, the hydrophobic treatment may be so carried out as to be from 40 to 98 as methanol wettability. The methanol wettability is the degree by which the wettability to methanol is evaluated. As a method therefor, inorganic fine particles for measurement which have been weighed in an amount of 0.2 g are added to 50 ml of distilled water put in a beaker of 200 ml in internal volume. From a burette the end of which is immersed in a liquid, methanol is slowly dropped until the whole inorganic fine particles become wet in the state of being slowly stirred. Where the quantity of methanol necessary for completely wetting the inorganic fine particles is represented by a (ml), the degree of hydrophobicity is calculated according to the following expression. In addition, when the degree of hydrophobicity in a high level is to be measured, the measurement may be made using an appropriately larger beaker.

$$\text{Degree of hydrophobicity}=(a/(a+50))\times 100.$$

The inorganic fine particles may be added in an amount of from 0.1 to 5.0% by weight, and preferably from 0.5 to 4.0% by weight, in the toner. Also, as external additives, various agents may be used in combination.

The photosensitive member used in the, present invention is described below.

Where a photosensitive member having a modulus of elastic deformation Wo of from 46% to 65% and an HU (universal hardness value) of from $1.5\times10^8$ N/M$^2$ to $2.3\times10^8$ N/m$^2$ under indentation at a maximum load of 6 mN is used, the carrier having an average circularity C of from 0.830 to 0.950 and containing 20% by number or less of particles having a value of (average circularity C−2σ) or less σ is standard deviation of carrier circularity) may be used in combination, whereby the photosensitive member can be prevented from being abraded by the carrier and also the photosensitive member surface can be prevented from being finely scratched, to have a high durability. To further improve characteristics, the photosensitive member may more preferably have a modulus of elastic deformation Wo of from 48% to 64%.

The HU and the modulus of elastic deformation Wo can not be grasped separately. For example, if the photosensitive member has a modulus of elastic deformation Wo of less than 46% in a case in which the photosensitive member has an HU of more than $2.3\times10^8$ N/m$^2$ and in a case in which it rubs against a cleaning blade at a large friction in an environment of high temperature or the like, the photosensitive member may have an insufficient elasticity. If on the other hand the photosensitive member has a modulus of elastic deformation Wo of more than.65% in such cases, it may elastically deform in a small level while having a high modulus of elastic deformation. Accordingly, a high pressure may locally be applied to a small number of carrier adhesion particles or 80 nm or larger external-additive fine particles of fogging toner to deeply scratch the photosensitive member. Thus, it is considered that one having a high HU is not necessarily optimum as the photosensitive member.

If on the other hand the photosensitive member has an HU of less than $1.5\times10^8$ N/m$^2$ and a modulus of elastic deformation Wo of more than 65%, it may elastically deform in a large level even though having a high modulus of elastic deformation, so that it may be abraded or be finely scratched due to rubbing with paper dust or toner held between it and the cleaning blade or charging roller. Also, if the photosensitive member has a modulus of elastic deformation Wo of less than 48%, it tends to be scratched to have poor durability (running performance).

The modulus of elastic deformation required in the present invention can be achieved by selecting materials of the photosensitive member surface. Preferably, as will be described below, a protective layer for additionally imparting strength may be provided so that the range of material selection for a charge transport layer can be broadened and a material having a higher charge mobility can be used as a charge-transfer material.

The electrophotographic photosensitive member used in the present invention is comprised of a support and a charge generation layer having a charge-generating material and a charge transport layer having a charge-transporting material in this order provided on the support. A protective layer may further be provided at the outermost surface. Also, a binding layer and further a subbing layer aiming at prevention of interference fringes may be provided between the support and the charge generation layer.

As for the support, it may be one having conductivity in itself. For example, as the support, the following may be cited: supports made of aluminum, aluminum alloy or stainless steel, and besides supports having layers film-formed by vacuum deposition of aluminum, aluminum alloy or indium oxide-tin oxide alloy, supports comprising plastic or paper impregnated with conductive fine particles (e.g., carbon black, tin oxide, titanium oxide or silver particles) together with a suitable binder resin, and plastics having a conductive binder resin.

A binding layer (an adhesion layer) having a function as a barrier and the function of adhesion may be provided between the support and the photosensitive layer. The binding layer is formed for the purposes of, e.g., improving the adhesion of the photosensitive layer, improving coating performance, protecting the support, covering defects of the support, improving the injection of electric charges from the support and protecting the photosensitive layer from electrical breakdown. The binding layer may be formed of, e.g., casein, polyvinyl alcohol, ethyl cellulose, an ethylene-acrylic acid copolymer, polyamide, modified polyamide, polyurethane, gelatin or aluminum oxide. The binding layer may preferably have a layer thickness of 5 μm or less, and more preferably from 0.1 μm to 3 μm.

The charge-generating material used in the present invention may include (1) azo pigments such as monoazo, disazo and trisazo, (2) phthalocyanine pigments such as metal phthalocyanines and metal-free phthalocyanine, (3) indigo pigments such as indigo and thioindigo, (4) perylene pigments such as perylene acid anhydrides and perylene acid imides, (5) polycyclic quinone pigments such as anthraquinone and pyrenequinone, (6) squarilium dyes, (7) pyrylium salts and thiapyrylium salts, (8) triphenylmethane dyes, (9) inorganic materials such as selenium, selenium-tellurium, and amorphous silicon, (10) quinacridone pigments, (11) azulenium salt pigments, (12) cyanine dyes, (13) xanthene dyes, (14) quinoneimine dyes, (15) styryl dyes, (16) cadmium sulfide and (17) zinc oxide.

A binder resin used to form the charge generation layer may include polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. Examples are by no means limited to these. Any of these may be used alone or in the form of a mixture or copolymer of two or more types.

A solvent used for a charge generation layer coating fluid may be selected taking into account the resin to be used and the solubility or dispersion stability of the charge-generating material. As an organic solvent, alcohols, sulfoxides, ketones, ethers, esters, aliphatic halogenated hydrocarbons or aromatic compounds may be used.

To form the charge generation layer, the above charge-generating material may be thoroughly dispersed in the binder resin, which is used in a 0.3- to 4-fold quantity by weight, together with the solvent by means of a homogenizer, an ultrasonic dispersion machine, a ball mill, a sand mill, an attritor or a roll mill, and the resultant dispersion is applied, followed by drying. It may preferably be formed in a layer thickness of 5 μm or less, and particularly within the range of from 0.01 μm to 1 μm.

To the charge generation layer, a sensitizer, an antioxidant, an ultraviolet absorber and a plasticizer which may be of various types, and any known charge-generating material may also optionally be added.

As a binder resin used to form the charge transport layer, it is preferred to use resins selected from from acrylic resins, styrene resins, polyester resins, polycarbonate resins, polyarylate resins, polyarylate resins, polysulfone resins, polyphenylene oxide resins, epoxy resins, polyurethane resins, alkyd resins and unsaturated resins. Particularly preferred resins may include polymethyl methacrylate, polystyrene, a styrene-acrylonitrile copolymer, polycarbonate resins and diallyl phthalate resins.

The charge-transporting material used in the charge transport layer may include various triarylamine compounds, various hydrazone compounds, various styryl compounds, various stilbene compounds, various pyrazoline compounds, various oxazole compounds, various thiazole compounds, and various triarylmethane compounds.

The charge transport layer may commonly be formed by applying a solution prepared by dissolving the above charge-transporting material and binder resin in a solvent, followed by drying. The charge-transporting material and the binder resin may be mixed in a proportion of from about 2:1 to 1:2 in weight ratio. As the usable solvent, the following may be cited: ketones such as acetone and methyl ethyl ketone, esters such as methyl acetate and ethyl acetate, aromatic hydrocarbons such as toluene and xylene, chlorine type hydrocarbons such as chlorobenzene, chloroform and carbon tetrachloride and ethers such as tetrahydrofuran and dioxane. When this coating solution is applied, coating methods as exemplified by dip coating, spray coating and spinner coating may be used. The drying may be carried out at a temperature ranging from 10° C. to 200° C., and preferably from 20° C. to 150° C., for a time of preferably from 5 minutes to 5 hours, and more preferably from 10 minutes to 2 hours, under air drying or drying at rest.

The charge transport layer is kept electrically connected with the above charge generation layer. It has the function of receiving charge carriers injected from the charge generation layer in the presence of an electric field and at the same time transporting these charge carriers to the interface between it and the protective layer. This charge transport layer has a limit of transporting charge carriers, and hence can not be made to have a larger layer thickness than necessary. Its layer thickness may preferably be within the range of from 5 to 30 μm, and particularly preferably from 7 to 20 μm. Also, the charge carriers are diffused, and hence, where the layer thickness is large, electric charges on the photosensitive member surface may spread over latent images to resulting in deterioration in dot reproducibility. Hence, its layer thickness may more preferably be within the range of from 7 to 15 μm.

To the charge transport layer, an antioxidant, an ultraviolet absorber, a plasticizer and any known charge-transporting material may further optionally be added.

It is further preferable that, on this charge transport layer, a surface layer is provided which is formed of a curable resin as a binder resin. The surface layer is provided in the form of a second charge transport layer made to have the function of charge transport (in this case, the original charge transport layer is called "first charge transport layer"), or a protective layer having substantially no function of charge transport. The second charge transport layer or the protective layer may be film-formed by coating and curing, thus the photosensitive member having a modulus of elastic deformation of from 46% to 65% is completed.

As the second charge transport layer, a layer may preferably be used which contains a compound formed by polymerizing a hole-transporting compound having two or more chain polymerizable functional groups, represented by the following chemical formula (a):

$$[p^1]_a\text{-}A\text{-}[Z\text{-}[p^2]_d]_b \qquad \text{(a)}$$

wherein A represents a hole-transporting group; $p^1$ and $p^2$ are each independently a chain polymerizable functional group; Z represents a substituted or unsubstituted organic residual group; and a, b and d are each independently an integer of 0 or 1 or more, the value of a+b×d is 2 or more, and when a is 2 or more, $p^1$'s may be the same or different, when d is 2 or more, $p^2$'s may be the same or different, and when b is 2 or more, Z and $p^2$ may be the same or different.

Letter symbol A in the above chemical formula (a) represents a hole-transporting group, and may be any group as long as it exhibits hole transportability. A group represented by the following chemical formula (b) is preferable:

(b)

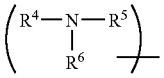

wherein $R^4$ $R^5$ and $R^6$ are each independnetly a substituted or unsubstituted alkyl group having 1 to 10 carbon atoms such as a substituted or unsubstituted methyl group, ethyl group, propyl group or butyl group, a substituted or unsubstituted aralkyl group such as a substituted or unsubstituted benzyl group, phenethyl group, naphthylmethyl group, furfury group or thienyl group, or a substituted or unsubstituted aryl group such as a substituted or unsubstituted phenyl group, naphthyl group, anthryl group, phenanthryl group, pyrenyl group, thiophenyl group, furyl group, pyridyl group, quinolyl group, benzoquinolyl group, carvazolyl group, phenothiazinyl group, benzofuryl group, benzothiophenl group, dibenzofuryl group or dibenzothiophenl group; provided that at least two of $R^4$, $R^5$ and $R^6$ each represent an aryl group.

Letter symbol Z in the above chemical formula (a) represents any one of, or any desired combination of, organic residual groups selected from a substituted or unsubstituted alkylene group, a substituted or unsubstituted arylene group, $CR^1{=}CR^2$ ($R^1$ and $R^2$ are each independently an alkyl group, an aryl group or a hydrogen atom), C═O—, S═O, SO2, an oxygen atom and a sulfur atom.

The chain polymerizable functional group in the present invention is described below. Where the reaction of forming a high-molecular product is roughly classified into chain polymerization and successive polymerization, the chain polymerization referred to in the present invention is meant to be the former form of polymerization reaction, and in particular, refers to unsaturation polymerization, ring-opening polymerization and isomerization polymerization or the like, in which the reaction proceeds chiefly via an intermediate such as radicals or ions, as described in Tadahiro Miwa, "Basic, Chemistry of Synthetic Resins (New Edition)", Gihodo Shuppan Co., Ltd., the eighth impression of the first edition, p. 24, Jul. 25, 1995.

The chain polymerizable functional group P in the above chemical formula (a) is meant to be a functional group which can have the above reaction form, and what is preferred in the present invention is represented by the following structural formula (1):

(1)

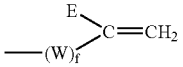

wherein E represents a hydrogen atom, a halogen atom, a substituted or unsubstituted alkyl group, a substituted or unsubstituted aryl group, a cyano group, a nitro group, an alkoxyl group, —$COOR^1$ ($R^1$ represents a hydrogen atom, a halogen atom, a substituted or unsubstituted alkyl group, a substituted or unsubstituted aralkyl group or a substituted or unsubstituted aryl group), $CONR^2R^8$ ($R^2$ and $R^8$ are each independently a hydrogen atom, a halogen atom, a substituted or unsubstituted alkyl group, a substituted or unsubstituted aralkyl group or a substituted or unsubstituted aryl group); W represents a substituted or unsubstituted divalent arylene group, a substituted or unsubstituted divalent alkylene group, —COO—, —C—, —O—, —OO—, —S—, —$CONR^4$— ($R^4$ represents a hydrogen atom, a halogen atom, a substituted or unsubstituted alkyl group, a substituted or unsubstituted aralkyl group or a substituted or unsubstituted aryl group); and f represents an integer of 0 or 1.

Particularly preferable forms of the chain polymerizable functional group in the above chemical formula (a) are further shown below.

(2)

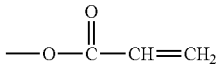

(3)

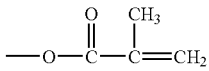

(4)

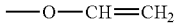

(5)

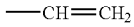

(6)

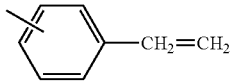

The hole-transporting compound having two or more chain polymerizable functional groups in the same molecule is polymerized so that in the second charge transport layer, the compound having hole transportability is incorporated into a three-deminsional structure via a covalent bond, having at least two cross-linking points. The hole-transporting compound may be polymerized singly, or may be mixed with a compound having a different chain polymerizable group, any of which is possible, and types and proportions are all optional. The compound having a different chain polymerizable group referred to herein may include any of monomers or oligomers or polymers having a chain polymerizable group.

Where the functional group of the hole-transporting compound and the functional group of another chain polymerizable compound are the same or are groups polymerizable with each other, the two may have a copolymerized three-dimensional cross-linked structure having a covalent bond. Where the functional groups of the two are functional groups not polymerizable with each other, the photosensitive layer is made up as a mixture of at least two three-dimensionally cured products, or as what contains a different chain polymerizable compound monomer or a cured product thereof in the chief-component three-dimensionally cured product, and their mixing proportion and film-forming methods may be suitably controlled so that an IPN (inter-penetrating network), i.e., a mutually penetrated network structure can be formed to have strength and toughness.

In the present invention, the second charge transport layer containing the cured product of the hole-transporting compound having such a chain polymerizable functional group may also be incorporated with a charge-transporting material.

In the case where a protective layer containing no charge-transporting material is formed as the surface layer, it is preferred to contain a resin having film-forming properties, such as polycarbonate resin, polyarylate resin, polystyrene resin or polymethacrylate resin. In such a case, the protective layer may preferably have a layer thickness of from 1 μm to 20 μm, and particularly from 5 μm to 15 μm.

In the present invention, in the second charge transport layer and the protective layer, as least one selected from the group consisting of a fluorine atom-containing resin, a fluorocarbon and a polyolefin resin is incorporated as a lubricant. Preferred compounds thereof may include the following, but are by no means limited to them.

What is preferable as the fluorine atom-containing resin may include polymer or copolymer resins and fine resin particles of a compound selected from vinyl fluoride, vinylidene fluoride, chlorotrifluoethylene, tetrafluoethylene, hexafluoethylene, perflupropylene, and perfluoalkyl vinyl ether.

The fluorocarbon may include compounds represented by $(CF)_n$ and $(C_2F)_n$.

What is preferable as the polyolefin resin may include homopolymer resins such as polyethylene resin, polypropylene resin and polybutene resin, and copolymer resins and fine resin particles of an ethylene-propylene copolymer and an ethylene-butene copolymer.

Any of these lubricants may be used alone or in a combination of two or more kinds in any desired proportion.

The second charge transport layer and the protective layer may also contain a dispersant for the lubricant, a dispersing agent, other various additives, a surface-active agent and so forth.

Inasmuch as the second charge transport layer and the protective layer are incorporated with at least one of the fluorine atom-containing resin, the fluorocarbon and the polyolefin resin, the photosensitive member can be improved in its surface slipperiness and water repellency, can be prevented from undergoing a lowering of transfer efficiency or slipperiness accompanying chemical deterioration in the surface layer due to charging, development, transfer and so forth during repeated service, can further be prevented from undergoing deterioration of electrical properties such as a lowering of sensitivity and a lowering of potential, and can be prevented from being finely scratched even when repeated used, to keep faulty images such as faint images and smeared images from occurring. Particularly preferably, the lubricant may be the fluorine atom-containing resin to obtain more favorable results.

In the present invention, the lubricant may preferably be contained in the second charge transport layer and in the protective layer in an amount of from 1 to 70% by weight, and more preferably from 5 to 50% by weight, based on the total weight of the layer serving as the surface layer. If the lubricant is in an amount of more than 70% by weight, the layer serving as the surface layer tends to have a low mechanical strength. It it is in an amount of less than 1% by weight, the layer serving as the surface layer may have insufficient water repellency and slipperiness.

A method for forming the second charge transport layer is commonly carried out by applying a solution containing the hole-transporting compound, then conducting polymerization reaction. Alternatively, a solution containing the hole-transporting compound may previously be allowed to react to produce a cured product, which is dissolved or dispersed again in a solvent, followed by coating. These solutions or dispersions may be applied by a method including, e.g., dip coating, spray coating, curtain coating and spinner coating. Dip coating is preferred in view of efficiency and productivity.

As methods for curing to form the second charge transport layer, the compound may be subjected to polymerization reaction by the use of heat, ultraviolet rays, electron rays or the like to effect curing. Taking into account productivity, energy efficiency and so forth, the compound may preferably be cured by a method described below.

In the present invention, the hole-transporting compound having a chain polymerizable functional group may preferably be polymerized by radiation polymerization. The radiation polymerization has such a great advantage that no polymerization initiator is required, thereby enabling a very high-purity three-dimensional photosensitive layer to be formed and securing good electrophotographic performance. It also gives such an advantages that high productivity is achievable due to short-time and efficient polymerization reaction, and further, because of good transmission of radiations, the influence of curing inhibition can be very small even when a thick film is formed or when some shielding substance such as an additive is present in the film. However, it is difficult fro the polymerization reaction to proceed, depending on the type of the chain polymerizable functional group and the type of the central skeleton. In such a case, a polymerization initiator may be added as long as it has no bad influence.

The radiation used here includes electron rays and γ-rays. An accelerator usable in the irradiation with electron rays may be of any type of a scanning type, an electron curtain type, a broad beam type, a pulse type and a laminar type. In the case of irradiation with electron rays, irradiation conditions are very important in the photosensitive member in the present invention in order to bring out its electrical properties and running performance. In the present invention, an accelerating voltage may preferably be 250 kV or less, and most preferably 150 kV or less. Also, a radiation dose may preferably be in the range of from 10 kGy to 1,000 kGy. If the accelerating voltage is more than the above, the irradiation with electron rays is apt to greatly impair photosensitive member characteristics. Also, if the radiation dose is less than the above range, the curing tends to be insufficient, and if the radiation dose is more than the above range, the photosensitive member characteristics tend to deteriorate.

The second charge transport layer and the protective layer may diffuse charge carriers to lower dot reproducibility, and hence can not be formed to have a large layer thickness, which may preferably be from 0.5 μm to 10.0 μm, and particularly from 1.0 μm to 6.0 μm.

The photosensitive member according to the present invention is a thin-film photosensitive member, and the charge transport layer has a layer thickness of from 8.0 μm to 20.0 μm, which may more preferably be from 8.0 μm to 16.0 μm, and still more preferably from 8.0 μm to 12.0 μm. This layer thickness, in the case where the second charge transport layer is provided, refers to the total layer thickness of the first charge transport layer and second charge transport layer.

In addition, the total layer thickness as the photosensitive member may preferably be from 10 μm to 40 μm. In order to achieve both the dot reproducibility and the running performance, the total layer thickness may preferably be from 10 μm to 26 μm.

Preferable methods for measuring physical properties in the present invention are described below.

Measurement of Particle Size Distribution of Toner:

As a measuring instrument, Coulter Counter TA-II or Coulter Multisizer II (manufactured by Beckman Coulter, Inc.) is used. As an electrolytic solution, an aqueous solution of about 1% NaCl is used. The electrolytic solution includes an electrolytic solution prepared using first-grade sodium chloride and, e.g., ISOTON R-II (registered trademark; available from Coulter Scientific Japan Co.).

As for a method of measurement, 0.1 to 5 ml of a surface active agent, preferably alkylbenzene sulfonate, is added as a dispersant to 100 to 150 ml of the above aqueous electrolytic solution, and further 2 to 20 mg of a sample for measurement is added. The electrolytic solution in which the sample has been suspended is subjected to dispersion for about 1 minute to about 3 minutes in an ultrasonic dispersion machine. The volume distribution and number distribution of the sample are calculated by measuring the volume and number of the sample for each channel by means of the above measuring instrument, using an aperture of 100 μm as its aperture. The weight-average particle diameter (D4) of the sample is determined from these distributions obtained. As channels, the following 13 channels are used: 2.00 to less than 2.52 μm, 2.52 to less than less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less-than 32.00 μm, and 32.00 to less than 40.30 μm.

Measurement of Average Circularity of Toner:

The average circularity of the toner is measured with a flow type particle analyzer "FPIA-2100 Model" (manufactured by Sysmex Corporation), and is calculated using the following expressions.

Circle-equivalent diameter=(projected particle area/π)$^{1/2}$×2

Circularity=(circumference of a circle whose area is equal to the projected particle area)/(perimeter of projected particle image)

wherein the "projected particle area" is a binary-coded toner particle image area, and the "perimeter of projected particle image" is defined as a length of a border line obtained by connecting edge points of the toner particle image. The measurement is carried out using the perimeter of a particle image resulting from image processing at an image processing resolution of 512×512 (a pixel of 0.3 μm×0.3 μm) The circularity referred to in the present invention is an index that indicates the degree of surface unevenness of a toner particle, where 1.00 represents a perfect circle, i.e., indicates that a particle is perfectly spherical, and as the surface form becomes more complicated, the circularity value is smaller.

In addition, the average circularity T means an average value of circularity frequency distribution, and is calculated from the following expression where a circularity at a partition point i in particle size distribution (a central value) is represented by ti, and the number of particles measured is represented by m.

$$\text{Average circularity } T = \sum_{i=1}^{m} ci/m.$$

With the measuring instrument FPIA-2100 used in the present invention, the circularity of each particle is calculated, and according to the resulting circularity, particles are classified into classes such that the circularity of from 0.4 to 1.00 are divided every 0.01, and using the center values of the division points and the number of particles measured, the average circularity is calculated.

As for a specific way of measurement, 100 ml of ion-exchanged water from which impurities such as solid matter have been removed is prepared in a container, and a surface active agent, preferably alkylbenzene sulfonate, is added thereto as a dispersant. Thereafter, 0.02 g of a sample for measurement is uniformly dispersed. As a means for dispersing it, an ultrasonic dispersion mixer "TETORAL 50 Model" (manufactured by Nikkaki Bios Co.) is used, and dispersion treatment is carried out for 2 minutes to prepare a liquid dispersion for measurement. In that case, the liquid dispersion is appropriately cooled so that its temperature does not exceed 40° C. Also, in order to control variation in circularity, the flow type particle analyzer FPIA-2100 is installed in an environment whose temperature is adjusted to 23° C.±0.5° C. so that the in-machine temperature can be kept at 26 to 27° C., and autofocus control is performed using 2 μm latex particles at intervals of a cirtain time, and preferably at intervals of 2 hours.

In measuring the toner particle circularity, the above flow type particle analyzer is used and the concentration in the liquid dispersion is so adjusted again as to be 3,000 to 10,000 particles/μl at the time of measurement, where 1,000 or more particles are measured. After the measurement, using the data thus obtained from which the data on circle-equivalent diameters of less than 2 μm are excluded, and the average circularity T of the particles is determined.

As compared with "FPIA-1000" having ever been used to calculate shapes of toner particles, the measuring instrument "FPIA-2100" used in the present invention has been improved in precision of measurement of toner particle shapes due to an improvement in magnification of processed particle images and an enhancement of processing resolution from 256×256 to 512×512, thereby establishing more exacting capture of finer particles. Accordingly, where more accurate measurement of particle shapes is required as in the present invention, FPIA-2100 is more advantageous and provides more accurate information on shapes.

Measurement of Molecular Weight Distribution by GPC (Binder Resin for Toner, Resin which Forms Coat Layers:

The molecular weight on chromatograms by gel permeation chromatography (GPC) is measured under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a THF sample solution of resin which has been adjusted to have a sample concentration of form 0.05 to 0.6% by weight is injected thereinto to make measurement. An RI (refractive index) detector is used as a detector. As columns, in order to make precise measurement in the region of molecular weight of from 1,000 to 2,000,000, it is desirable to use a plurality of commercially available polystyrene gel columns in combination. For example, they may preferably comprise a combination of μ-Styragel 500, 1,000, 10,000 and 100,000, available from Waters Co. or a combination of Shodex KA-801, KA-802, KA-803, KA-804, KA-805, KA-806 and KA-807, available from Showa Denko K.K.

In measuring the molecular weight of the sample, the molecular weight distribution of the sample is calculated from the relationship between the logarithmic value of a calibration curve prepared using several kinds of monodisperse polystyrene standard samples and the count number. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Tosoh Corporation, and to use at least about 10 standard polystyrene samples.

In addition, as the resin which forms coat layers, a sample is used which is prepared by adding carrier particles to methyl ethyl ketone so as to be in a concentration of 10% by weight, followed by dispersion treatment for 2 minutes using an ultrasonic dispersion machine "TETORAL 50 Model" (manufactured by Nikkaki Bios Co.), and then filtration with a membrane filter of 0.2 μm in mesh opening, and drying the filtrate obtained.

Measurement of Maximum Endothermic Peak of Toner and Release Agent:

The maximum endothermic peak of the toner and release agent may be measured with a differential thermal analyzer (differential scanning calorimeter, DSC measuring instrument) DSC2920 (manufactured by TA Instruments Japan Ltd.) according to ASTM D3418-82.

Temperature Curve:

Heating I (30° C. to 200° C.; heating rate: 10° C./min).

Cooling I (200° C. to 30° C.; Cooling rate: 10° C./min).

Heating II (30° C. to 200° C.; heating rate:10° C./min).

As a method of measurement, a sample for measurement is precisely weighed in an amount of from 5 to 20 mg, preferably 10 mg. This sample is put into an aluminum pan and an empty aluminum pan is used as reference. Measurement is made in a normal-temperature and normal-humidity environment at a heating rate of 10° C./min within the measuring temperature range of from 30° C. to 200° C. To determine the maximum endothermic peak of the toner and release agent, in the course of Heating II, a peak which is the highest from the base line of a region beyond endothermic peaks of the Tg of the resin, or when the endothermic peaks of the Tg of the resin overlap with different endothermic peaks and are difficult to distinguish, a peak which is the highest from the maximum peak of the overlapping peaks, is regarded as the maximum endothermic peak of the toner and release agent in the present invention.

Measurement of Particle Diameters of Inorganic Fine Particles and External Additives of Toner:

As to the particle diameters of the inorganic fine particles and external additives of the toner, 500 or more particles of 5 nm or more in particle diameter are picked out at random on a scanning electron microscope (50,000 magnifications), and their lengths and breads are measured with a digitizer. What has been averaged out is regarded as the particle diameter, which is calculated as maximum peak particle diameter of the inorganic fine particles and external additives on the basis of the particle diameter that corresponds to the peak at the center value of columns, of particle size distribution of 500 or more particles (from a histogram of columns whose column widths are divided at intervals of 10 nm, as 5-15, 15-25, 25-35, 35-45, 45-55, 55-65, 65-75, 75-85, 85-95 and so on).

Measurement of Particle Diameter of Carrier:

As to the particle diameter of magnetic carrier particles, it may be measured by the dry process, using a particle size distribution measuring instrument employing a system in which a group of particles is detected as a light-intensity distribution pattern, such as a laser diffraction particle size distribution measuring instrument. Any instrument may be used as long as it can make measurement in a measuring range of from submicrons to hundreds of microns. For example, SALD-3100, manufactured by Shimadzu Corporation, may be used to make measurement, and the volume-average particle diameter (Dv) is calculated.

Measurement of Number-Based Average Circularity C and Standard Deviation σ of Carrier:

As to the average circularity C of the carrier, number-based average circularity C is calculated using Multi-image Analyzer (manufactured by Beckman Coulter, Inc.). In measurement, a mixture solution of an aqueous solution of about 1% NaCl as an electrolytic solution and glycerol in a ratio of 50% by volume to 50% by volume is used. To prepare the electrolytic solution, usable are an electrolytic solution prepared using first-grade sodium chloride and, e.g., ISOTON R-II (registered trademark; available from Coulter Scientific Japan Co.). As the glycerol, a guaranteed reagent or first-grade reagent may be used. As a dispersant, 0.1 to 1.0 ml of a surface active agent, preferably an alkylbenzenesulfonate, is added to about 30 ml of the aqueous electrolytic solution, and further 2 to 20 mg of a sample for measurement is added. The electrolytic solution in which the sample has been suspended is subjected to dispersion for about 1 minute in an ultrasonic dispersion machine. The circle-equivalent diameter and average circularity C are calculated by means of the above measuring instrument, using an aperture of 200 μm as its aperture, and a lens of 20 magnifications. Conditions in making the measurement are as follows.

Average luminance in measuring frame: 220 to 230.

Setting of measuring frame: 300.

SH (threshold): 50.

Binary coding level: 180

In measurement, the electrolytic solution/glycerol mixture solution is put-into a measuring container made of glass. The sample shown above is put into it so as to be in a concentration of 5% to 10%, and stirred at a maximum stirring speed. Suction pressure of the sample is set to 10 kPa. Since the carrier has a large specific gravity and tends to settle, measuring time is so set as to be 15 to 30 minutes. Also, the measurement is interrupted at intervals of 5 to 10 minutes to replenish the sample solution and replenish the the electrolytic solution/glycerol mixture solution. After each replenishment, the measurement is again started. The measurement is made on 2,000 particles. After the measurement has been completed, unfocused images and agglomerated particles (simultaneous measurement in, plurality) or the like are removed by main-body software. The measurement principle of this instrument is that a strobe is flashed using as triggers the electric-current pulses generated when particles pass through the aperture in Coulter Multisizer II, and their photographed images are recorded in a CCD (charge-coupled device) to perform image analysis processing. The plots on the graph obtained and the particle image photographs correspond one to one, and hence the unfocused images and agglomerated particles can be removed as stated above.

Circularity and circle-equivalent diameter are calculated according to the following expressions.

$$\text{Circularity}=(4\times\text{Area})/(\text{MaxLengh}_2\times\pi).$$

$$\text{Circle-equivalent diameter}=2\times(\text{Area})/\pi).$$

Here, "Area" is the projected area of a binary-coded carrier particle image, "MaxLengh" is defined to be the maximum diameter of the carrier particle image projected area. Circle-equivalent diameters of 4 to 100 μm are divided into 256 classes, and are used in number-based logarithmic representation. FIG. 5 shows the results of actual measurement. The circle-equivalent diameters are plotted as abscissa. The left axis shows number-based particle size frequencies (%), which are displayed by a bar graph. The right axis shows circularities, which are displayed by dots. The value of average circularity C−2σ is calculated from the average circularity C and standard deviation a determined on main-body software, and the number of particles having the value of average circularity C−2σ or less are determined from the graph, where the values found are divided by the number of the whole particles to determine the presence percentage. These, a series of measurement and calculation are processed in software attached to Multi-image Analyzer.

Measurement of Particle Diameters of Magnetic Material and Non-Magnetic Inorganic Compound in Carrier:

As to the particle diameter of the magnetic material and non-magnetic inorganic compound, cross sections of 300 or more carrier particles of 5 nm or more in particle diameter, cut with a microtome or the like, are picked out-at random on a scanning electron microscope (50,000 magnifications), and their lengths and breads are measured with a digitizer. What has been averaged out is regarded as the particle diameter, and the maximum peak particle diameter is calculated on the basis of the particle diameter at the center value of columns that corresponds to the peak of particle size distribution of 300 or more particles (from a histogram of columns whose column widths are divided at intervals of 10 nm, as 5-15, 15-25, 25-35, 35-45, 45-55, 55-65, 65-75, 75-85, 85-95 and so on).

As another method for measuring the particle diameter of the magnetic material and non-magnetic inorganic compound, the average particle diameter may be determined in the same manner as the above method, but using a photograph of raw-materials, taken at 50,000 magnifications on a transmission electron microscope (TEM).

Measurement of Particle Diameter of Fine Particles in Carrier Coat Resin:

As to the particle diameter of the fine particles in the carrier coat resin, 500 or more particles of 5 nm or more in particle diameter are picked out at random on a scanning electron microscope (50,000 magnifications) from a component obtained by dissolving the coat material out of the carrier in a solvent capable of dissolving the coat material, such as toluene, and their lengths and breads are measured with a digitizer. What has been averaged out is regarded as the particle diameter, and the maximum peak particle diameter is calculated on the basis of the particle diameter that corresponds to the peak at the center value of columns, of particle size distribution of 500 or more particles (from a histogram of columns whose column widths are divided at intervals of 10 nm, as 5-15, 15-25, 25-35, 35-45, 45-55, 55-65, 65-75, 75-85, 85-95 and so on).

As another method for measuring the particle diameter of the fine particles in the carrier core resin, the average particle diameter may be determined in the same manner as the above method, but using a photograph of a raw-material, taken at 50,000 magnifications on a transmission electron microscope (TEM).

Measurement of Intensity of Magnetization of Carrier:

The intensity of magnetization of the carrier may be measured with a vibration magnetic-field type magnetic-property autographic recorder BHV-30, manufactured by Riken Denshi Co., Ltd. As a method of measuring the same, a cylindrical plastic container is filled with the carrier in such a way that it is well densely packed, and meanwhile an external magnetic field of 79.6 kA/m (1 kOe) is formed. In this state, the magnetic moment of the carrier filled in the container is measured. Further, the actual weight of the carrier filled in the container is measured to determine the intensity of magnetization ($Am^2/kg$). Still further, the value obtained is multiplied by the true specific gravity ($g/cm^3$) of the carrier, thus the intensity of magnetization per carrier volume ($kAm^2/cm^3$) can be determined.

Measurement of True Specific Gravity of Carrier:

The true specific gravity of the carrier may be determined by means of a dry automatic densitometer Auto Picnometer (manufactured by Yuasa Ionics Co.).

Figure 4:
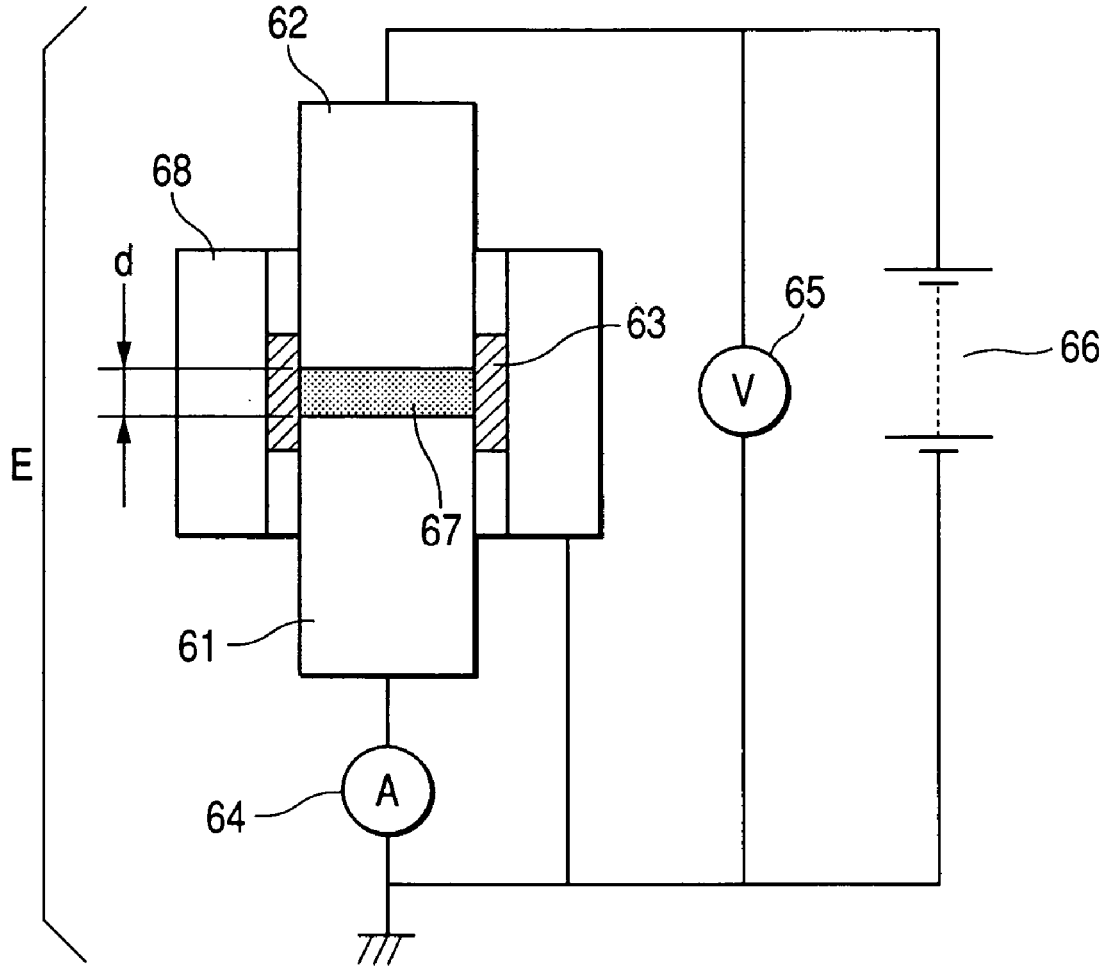
FIG. 4 is a schematic sectional view of an instrument which measures resistivity of the carrier, magnetic material and non-magnetic inorganic compound used in the present invention.

Measurement of Resistivity of Carrier, Non-Magnetic Inorganic Compound and Magnetic Material:

The resistivity of the carrier, non-magnetic inorganic compound and magnetic material is measured with a measuring instrument shown in FIG. 4. A method is employed in which a cell E is filled with sample particles, and a lower electrode 61 and an upper electrode 62 are provided in contact with the particles filled, where voltage is applied across these electrodes while lowering it by means of a constant-voltage device 66 every 30 seconds at intervals of 200 V from 1,000 V to 200 V, and electric current flowing at each moment is measured with an ammeter 64 to determine the resistivity. Conditions for measuring the resistivity in the present invention are set as follows: Contact area S between the particles filled and the electrodes: about 2.4 $cm^2$; sample thickness L: about 0.2 cm; and load of the upper electrode 62: 180 g. Resistance values at the voltages of from 1,000 V to 200 V are respectively plotted. From the profile obtained, the value of resistivity that comes to 4,000 V/cm is found on the graph to regard it as the resistivity. In FIG. 4, reference numeral 63 denotes an insulating material; 65, a voltmeter; 68, a guide ring; and E, the resistance measuring cell.

Measurement of Surface Physical Properties of Photosensitive Member:

The photosensitive member is left for 24 hours in an environment of 25° C. and humidity 50%, and thereafter the HU and the modulus of elastic deformation Wo are determined using a microhardness measuring instrument FISCHER SCOPE H100V (manufactured by Helmut Fischer GmbH).

The HU (universal hardness value) and the modulus of elastic deformation Wo in the present invention are measured with the microhardness measuring instrument FISCHER-SCOPE H100V (manufactured by Helmut Fischer GmbH), in which a load is continuously applied to an indenter and the depth of indentation is directly read to determine continuous hardness. As the indenter, used is Vickers quadrangular pyramid diamond indenter of 136° in angle between the opposite faces. The load is stepwise applied up to a final load of 6 mN (at 273 spots with retention time of 0.1 s for each spot).

Figure 6:
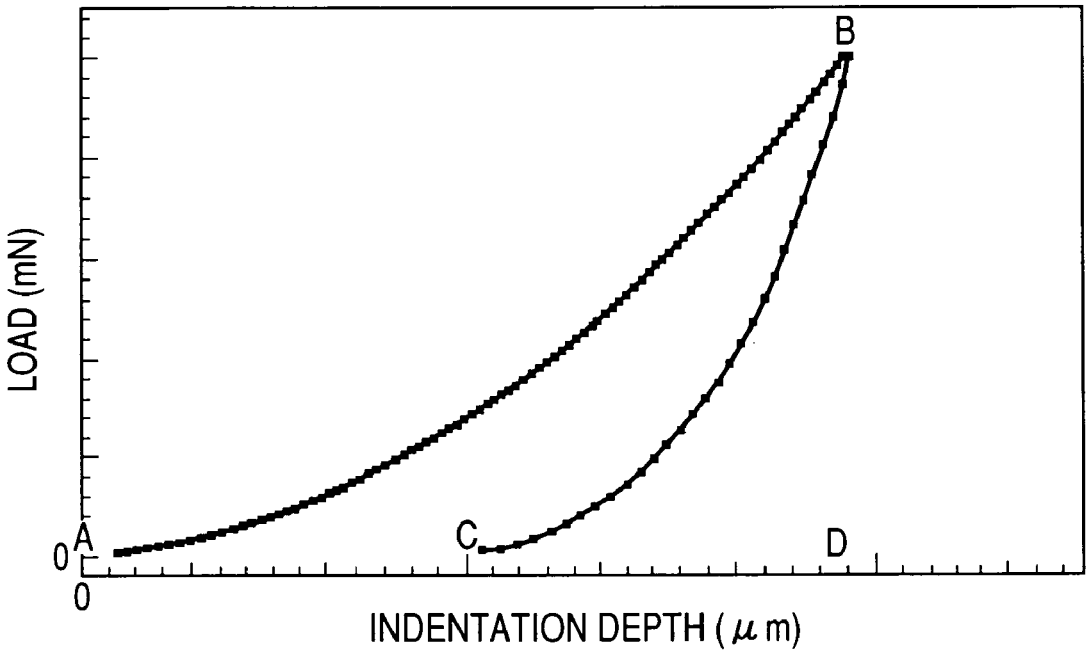
FIG. 6 is a schematic view showing an output chart for measuring modulus of surface elasticity of the photosensitive member used in the present invention.

An output chart is schematically shown in FIG. 6. The load (mN) is plotted as ordinate, and the indentation depth (μm) as abscissa. The load is stepwise increased to apply the load up to 6 mN, and thereafter the load is similarly stepwise decreased, to obtain the results as shown therein.

The HU (universal hardness value; hereinafter "HU") is prescribed by the following expression (1) from indentation depth under application of the same load when indented at 6 mN.

$$HU = \text{Test load } (N)/\text{Surface are } (mm^2) \text{ of Vickers indenter under test load} = 0.006/26.43\ h^2 (N/mm^2). \quad (1)$$

$h$: Indentation depth under test load.

The modulus of elastic deformation Wo is the value found from the work done (energy) by the indenter against the film, i.e., changes in energy which are due to an increase or decrease of the load applied by the indenter to the film. Its value is found from the following expression (2).

Modulus of Elastic Deformation $$Wo(\%) = (We/Wt) \times 100. \quad (2)$$

EXAMPLES

The present invention is described below in greater detail by giving specific working examples. The present invention is by no means limited to these examples.

Carrier Production Example A

To each of fine magnetite particles having a number-average particle diameter of 250 nm and a resistivity of $5.1\times10^5$ Ω·cm (intensity of magnetization under 79.6 kA/m: 64 $Am^2$/kg; true specific gravity: 5.2 g/$cm^3$) and fine hematite particles having a number-average particle diameter of 260 nm and a resistivity of $4.9\times10^7$ Ω·cm (non-magnetic; true specific gravity: 5.1 g/$cm^3$), 4.0% by weight of a silane coupling agent 3-(2-aminoethylaminopropyl)trimethoxysilane was added, and these were high-speed mixed and agitated at 110° C. in a container to carry out surface treatment.

| | (by weight) |
|---|---|
| Phenol | 10 parts |
| Formaldehyde solution (aqueous 37% by weight formaldehyde solution) | 6 parts |
| Above treated fine magnetite particles | 76 parts |
| Above treated fine hematite particles | 8 parts |

The above materials, and 5 parts by weight of 28% by weight ammonia water and 10 parts by weight of water were put into a flask, and were thoroughly mixed. At this point, the dissolved oxygen in the reaction medium was 7.3 g/$m^3$. Subsequently, nitrogen gas was introduced into this reaction medium. The nitrogen gas was introduced at a flow rate of $1.5\times10^{-2}m^3$/h to effect displacement for 20 minutes. Also, at this point, the dissolved oxygen in the reaction medium was 1.0 g/$m^3$. After that, nitrogen gas was introduced at a flow rate kept low to $0.3\times10^{-2}m^3$/h, where the reaction system was heated at an average heating rate of 3.0° C./minute from room temperature to 85° C. with stirring, and was kept at that temperature to carry out polymerization reaction for 3 hours and effect curing. Here, the peripheral speed of the stirring blade was set to 1.8 m/sec. Thereafter, the system was cooled to 30° C., and water was further added thereto. Thereafter, the supernatant liquid was removed, and the precipitate formed was washed with water, followed by air drying. Subsequently, this was dried at a temperature of 60° C. under reduced pressure (5 hPa or less) to obtain spherical magnetic carrier cores (a) having a volume average particle diameter of 35.1 μm, in which the magnetic materials stood dispersed.

3 parts by weight of a methyl methacrylate macromonomer having an ethylenically unsaturated group at one terminal and having a weight-average molecular weight of 5,000, 25 parts by weight of a monomer shown below as Exemplary Compound 1, and 72 parts by weight of methyl methacrylate were introduced into a four-necked flask provided with a reflux condenser, a thermometer, a nitrogen suction tube and a ground-in type stirrer. Further, 100 parts by weight of toluene, 100 parts by weight of methyl ethyl ketone and 2.4 parts by weight of azobisisovaleronitrile were added, and these were kept at 80° C. for 10 hours in a stream of nitrogen to carry out polymerization to obtain a graft copolymer solution (solid content: 33% by weight). The graft copolymer had a weight-average molecular weight of 22,000 as measured by gel permeation chromatography (GPC).

Exemplary Compound 1

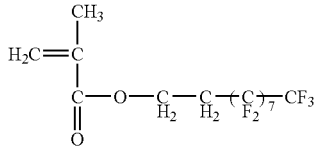

In 30 parts by weight of the graft copolymer solution (solid content: 33% by weight), 0.5 part by weight of cross-linked melamine resin particles (number-average particle diameter: 230 nm), 1.0 part by weight of carbon black (number-average particle diameter: 30 nm; DBP oil absorption: 40 ml/100 g) and 100 parts by weight of toluene were thoroughly mixed by means of a homogenizer to obtain a coating fluid. Subsequently, 1,000 parts by weight of the magnetic carrier cores (a) were agitated under continuous application of shear stress thereto by means of a vacuum deaeration kneader, during which the above coating fluid was slowly added, and then the solvent was evaporated off at 70° C., thus the carrier particle surfaces were coated with the resin. With agitation at 100° C. for 2 hours under conditions of a nitrogen flow rate of $0.3\times10^{-2}m^3$/h, the magnetic carrier core particles having been coated with the resin were heat-treated, and then cooled, followed by disintegration and then removal of coarse particles with a sieve of 76 μm in mesh opening to obtain Carrier A, having a volume-average particle diameter of 35.3 μm, a true specific gravity of 3.63 g/$cm^3$, an intensity of magnetization of 19.1 $kAm^2/m^3$, a resistivity of $6.2\times10^8$ Ω·cm, an average circularity C of 0.922 and a standard deviation a of 0.028, and containing particles having a value of (average circularity C−2σ)=0.866 or less, in a presence percentage of 2.1% by number. Incidentally, the carrier obtained had spherical to elliptic shape in almost all particles and only a little contained amorphous particles.

Carrier Production Example B

To each of fine magnetite particles having a number-average particle diameter of 250 nm and a resistivity of $5.1\times10^5$ Ω·cm (intensity of magnetization under 79.6 kA/m: 64 $\mu m^2$/kg; true specific gravity: 5.2 g/$cm^3$) and fine hematite particles having a number-average particle diameter of 610 nm and a resistivity of $1.3\times10^8$ Ω·cm (non-magnetic; true specific gravity: 5.3 g/$cm^3$), 0.8% by weight of a silane coupling agent 3-(2-aminoethylaminopropyl)trimethoxysilane was added, and these were high-speed mixed and agitated at 110° C. in a container to carry out surface treatment.

| | (by weight) |
|---|---|
| Phenol | 10 parts |
| Formaldehyde solution (aqueous 37% by weight formaldehyde solution) | 6 parts |
| Above treated fine magnetite particles | 60 parts |
| Above treated fine hematite particles | 24 parts |

The above materials, and 5 parts by weight of 28% by weight ammonia water and 10 parts by weight of water were put into a flask, and were thoroughly mixed. At this point, the dissolved oxygen in the reaction medium was 7.4 g/$m^3$. Subsequently, nitrogen gas was introduced into this reaction medium. The nitrogen gas was introduced at a flow rate of $1.5\times10^{-2}m^3$/h to effect displacement for 20 minutes. Also, at this point, the dissolved oxygen in the reaction medium was 1.2 g/m$^3$. After that, nitrogen gas was introduced at a flow rate kept low to $0.3\times10^{-2}$m$^3$/h, where the reaction system was heated at an average heating rate of 3.0° C./minute from room temperature to 85° C. with stirring, and was kept at that temperature to carry out polymerization reaction for 3 hours and effect curing. The subsequent procedure for the magnetic carrier cores (a) was repeated to obtain spherical magnetic carrier cores (b) having a volume average particle diameter of 36.7 μm, in which the magnetic materials stood dispersed.

The magnetic carrier cores (b) were coated in the same formulation as Carrier A to obtain Carrier B, having a volume-average particle diameter of 37.2 μm, a true specific gravity of 3.56 g/cm$^3$, an intensity of magnetization of 148 kAm$^2$/m$^3$, a resistivity of $7.3\times10^{11}$ Ω·cm, an average circularity C of 0.896 and a standard deviation v of 0.054, and containing particles having a value of (average circularity C−2σ)=0.788 or less, in a presence percentage of 5.3% by number. Incidentally, the carrier obtained had spherical to elliptic shape in almost all particles, some of which were seen to have slender elliptic shape, and only a little contained amorphous particles.

Carrier Production Example C

To each of fine magnetite particles having a number-average particle diameter of 250 nm and a resistivity of $5.1\times10^5$ Ω·cm (intensity of magnetization under 79.6 kA/m: 65 μm$^2$/kg; true specific gravity: 5.2 g/cm$^3$) and fine hematite particles having a number-average particle diameter of 260 nm and a resistivity of $4.9\times10^7$ Ω·cm (non-magnetic; true specific gravity: 5.1 g/cm$^3$), 3.0% by weight of a titanium type silane coupling agent isorpopyltri(N-aminoethyl-aminoethyl)titanate was added, and these were high-speed mixed and agitated at 110EC in a container to carry out surface treatment.

| | (by weight) |
|---|---|
| Phenol | 10 parts |
| Formaldehyde solution (aqueous 37% by weight formaldehyde solution) | 6 parts |
| Above treated fine magnetite particles | 76 parts |
| Above treated fine hematite particles | 8 parts |

The above materials, and 6 parts by weight of 28% by weight ammonia water and 8 parts by weight of water were put into a flask, and were thoroughly mixed. At this point, the dissolved oxygen in the reaction medium was 6.5 g/m$^3$. Subsequently, nitrogen gas was introduced into this reaction medium. The nitrogen gas was introduced at a flow rate of $1.5\times10^{-2}$m$^3$/h to effect displacement for 20 minutes. Also, at this point, the dissolved oxygen in the reaction medium was 1.1 g/m$^3$. After that, nitrogen gas was introduced at a flow rate kept low to $0.3\times10^{-2}$m$^3$/h, where the reaction system was heated at an average heating rate of 3.0° C./minute from room temperature to 85° C. with stirring, and was kept at that temperature to carry out polymerization reaction for 3 hours and effect curing. Here, the peripheral speed of the stirring blade was set to.1.2 m/sec. Thereafter, the system was cooled to 30° C., and water was further added thereto. Thereafter, the supernatant liquid was removed, and the precipitate formed was washed with water, followed by air drying. Subsequently, this was dried at a temperature of 60° C. under reduced pressure (5 hPa or less) to obtain spherical magnetic carrier cores (c) having a volume average particle diameter of 52.7 μm, in which the magnetic materials stood dispersed.

In 20 parts by weight of the same graft copolymer solution (solid content: 33% by weight) as that used in producing Carrier A, 0.3 part by weight of cross-linked melamine resin particles (number-average particle diameter: 200 nm), 0.6 part by weight of carbon black (number-average particle diameter: 30 nm; DBP oil absorption: 40 ml/100 g) and 100 parts by weight of toluene were thoroughly mixed by means of a homogenizer to obtain a coating fluid. Subsequently, 1,000 parts by weight of the magnetic carrier cores (c) were agitated under continuous application of shear stress, during which the above coating fluid was slowly added thereto, and then the solvent was evaporated off at 70° C., thus the carrier particle surfaces were coated with the resin. The subsequent procedure for Carrier A was repeated to obtain Carrier C, having a volume-average particle diameter of 53.2 μm, a true specific gravity of 3.63 g/cm$^3$, an intensity of magnetization of 194 kAm$^2$/m$^3$, a resistivity of $2.9\times10^9$ Ω·cm, an average circularity C of 0.902 and a standard deviation v of 0.053, and containing particles having a value of (average circularity C−2σ)=0.796 or less, in a presence percentage of 5.8% by number. The carrier obtained had spherical to elliptic shape in most particles, where those having somewhat slender elliptic shape were seen, and amorphous particles were present on the fine-powder side.

Carrier Production Example D

Fine magnetite particles having a number-average particle diameter of 220 nm were fired at 700° C. for 3 hours in air to obtain fine magnetite particles having a number-average particle diameter of 220 nm and a resistivity of $8.5\times10^7$ Ω·cm (intensity of magnetization under 79.6 kA/m: . . . Am$^2$/kg; true specific gravity: . . . g/cm$^3$). Thereafter, 4.0% by weight of a silane coupling agent 3-(2-aminoethylaminopropyl)trimethoxysilane was added thereto, and these were high-speed mixed and agitated at 120EC in a container to carry out surface treatment.

| | (by weight) |
|---|---|
| Phenol | 10 parts |
| Formaldehyde solution (aqueous 37% by weight formaldehyde solution) | 6 parts |
| Above treated fine magnetite particles | 84 parts |

The above materials, and 4 parts by weight of 28% by weight ammonia water and 12 parts by weight of water were put into a flask, and were thoroughly mixed. At this point, the dissolved oxygen in the reaction medium was 7.4 g/m$^3$. Subsequently, nitrogen gas was introduced into this reaction medium. The nitrogen gas was introduced at a flow rate of $1.5\times10^{-2}$m$^3$/h to effect displacement for 20 minutes. Also, at this point, the dissolved oxygen in the reaction medium was 0.88 g/m$^3$. After that, nitrogen gas was introduced at a flow rate kept low to $0.3\times10^{-2}$m$^3$/h, where the reaction system was heated at an average heating rate of 3.0° C/minute from room temperature to 85° C. with stirring, and was kept at that temperature to carry out polymerization reaction for 3 hours and effect curing. Here, the peripheral speed of the stirring blade was set to 2.4 m/sec. Thereafter, the system was cooled to 30° C., and water was further added thereto. Thereafter, the supernatant liquid was removed, and the precipitate formed was washed with water, followed by air drying. Subsequently, this was dried at a temperature of 60° C. under reduced pressure (5 hPa or less) to obtain spherical magnetic carrier cores (d) having a volume average particle diameter of 23.3 μm, in which the magnetic materials stood dispersed.

3 parts by weight of a methyl methacrylate macromonomer having an ethylenically unsaturated group at a terminal and having a weight-average molecular weight of 5,000, 20 parts by weight of a monomer shown below as Exemplary Compound 2, and 77 parts by weight of methyl methacrylate were introduced into a four-necked flask provided with a reflux condenser, a thermometer, a nitrogen suction tube and a ground-in type stirrer. Further, 100 parts by weight of toluene, 100 parts by weight of methyl ethyl ketone and 2.4 parts by weight of azobisisovaleronitrile were added, and these were kept at 80° C. for 10 hours in a stream of nitrogen to carry out polymerization to obtain a graft copolymer solution (solid content: 33% by weight). Its graft copolymer had a weight-average molecular weight of 21,000 as measured by gel permeation chromatography (GPC).

Exemplary Compound 2

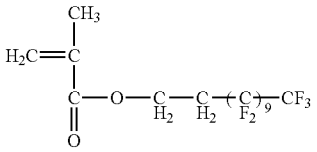

In 50 parts by weight of the graft copolymer solution obtained (solid content: 33% by weight), 1.0 part by weight of spherical silica particles (number-average particle diameter: 300 nm), 1.5 parts by weight of carbon black (number-average particle diameter: 30 nm; DBP oil absorption: 40 ml/100 g) and 100 parts by weight of toluene were thoroughly mixed by means of a homogenizer to obtain a coating fluid. Subsequently, 1,000 parts by weight of the magnetic carrier cores (d) were agitated under continuous application of shear stress, during which the above coating fluid was slowly added thereto, and then the solvent was evaporated off at 70° C., thus the carrier particle surfaces were coated with the resin. The subsequent procedure for Carrier A was repeated to obtain Carrier D, having a volume-average particle diameter of 23.5 μm, a true specific gravity of 3.57 g/cm$^3$, an intensity of magnetization of 187 kAm$^2$/m$^3$, a resistivity of $4.1\times10^9$ Ω·cm, an average circularity C of 0.874 and a standard deviation a of 0.052, and containing particles having a value of (average circularity C−2σ)=0.770 or less, in a presence percentage of 2.8% by number. The carrier obtained had spherical shape in some particles but had elliptic shape in most particles, and amorphous particles were little present.

Carrier Production Example E

Surfaces of 2,000 parts by weight of the magnetic carrier cores (c) were coated with 80 parts by weight of a 3% by weight methanol solution of a silane coupling agent y-aminopropyltrimethoxysilane under application of shear stress, during which the solvent was evaporated off.

Silicone resin SR2410 (available from Dow Corning Toray Silicone Co., Ltd.) was diluted with 200 parts by weight of toluene so as to be 10% by weight as silicone resin solid content. Thereafter, γ-aminopropyltrimethoxysilane was added in an amount of 8 parts by weight based on the weight of the silicone resin, and 2 parts by weight of spherical silica particles (number-average particle diameter: 280 nm) was further added, and these were well mixed by means of a homogenizer to prepare a coat material fluid.

The magnetic carrier cores (c) having been treated with the silane coupling agent were added to the coat material fluid under reduced pressure with stirring at 50° C. so as to be resin-coated with the above coat material. Thereafter, with stirring for 2 hours in an atmosphere of nitrogen gas while introducing nitrogen gas at a flow rate of $0.3\times10^{-2}$m$^3$/h, the toluene was evaporated off, and thereafter the carrier cores thus coated were heat-treated at 140° C. for 2 hours, and then cooled, followed by disintegration and then removal of coarse particles with a sieve of 76 μm in mesh opening to obtain Carrier E, having a volume-average particle diameter of 53.1 μm, a true specific gravity of 3.62 g/cm$^3$, an intensity of magnetization of 193 kAm$^2$/m$^3$, a resistivity of $9.9\times10^8$ Ω·cm, an average circularity C of 0.905 and a standard deviation v of 0.051, and containing particles having a value of (average circularity C−2σ)=0.803 or less, in a presence percentage of 5.4% by number. The carrier obtained had spherical to elliptic shape in most particles, and. amorphous particles were somewhat present on the fine-powder side.

Carrier Production Example F

Into a four-necked flask provided with a reflux condenser, a thermometer, a nitrogen suction tube and a ground-in type stirrer, 1,000 parts by weight of ion-exchanged water and 10 parts by weight of polyvinyl alcohol were introduced, and these were stirred until the latter dissolved completely in the former. Then, 33 parts by weight of cyclohexyl methacrylate monomer, 67 parts by weight of methyl methacrylate and 2 parts by weight of a polymerization initiator 2,2'-azobis(2,4-dimethylvaleronitrile) were mixed, and thereafter the mixture formed was added to the above flask, and was kept there at 80° C. for 10 hours in a stream of nitrogen to carry out polymerization to obtain a graft copolymer. The graft copolymer obtained was dried under reduced pressure to obtain a solid matter. The graft copolymer had a weight-average molecular weight of 20,000 as measured by gel permeation chromatography (GPC).

The above graft copolymer was diluted with toluene so as to be in a solid content of 33% by weight. In 30 parts by weight of this solution, 0.7 part by weight of cross-linked melamine resin particles (number-average particle diameter: 230 nm), 1.0 part by weight of carbon black (number-average particle diameter: 40 nm; DBP oil absorption: 80 ml/100 g) and 100 parts by weight of toluene were thoroughly mixed by means of a homogenizer to obtain a coating fluid. Subsequently, 1,000 parts by weight of the magnetic carrier cores (c) were agitated under continuous application of shear stress, during which the above coating fluid was slowly added, and then the solvent was evaporated off at 80° C., thus the carrier particle surfaces were coated with the resin. With agitation at 120° C. for 2 hours while controlling nitrogen flow rate to be $0.3\times10^{-2}$m$^3$/h, the magnetic carrier core particles having been coated with the resin were heat-treated, and then cooled, followed by disintegration and then removal of coarse particles with a sieve of 76 μm in mesh opening to obtain Carrier F, having a volume-average particle diameter of 53.8 μm, a true specific gravity of 3.60 g/cm$^3$, an intensity of magnetization of 191 kAm$^2$/m$^3$, a resistivity of $5.2\times10^8$ Ω·cm, an average circularity C of 0.900 and a standard deviation v of 0.055, and containing particles having a value of (average circularity C−2σ)=0.790 or less, in a presence percentage of 6.2% by number. The carrier obtained had spherical to elliptic shape in most particles, and amorphous particles were somewhat present on the fine-powder side.

Carrier Production Example G

The same fine magnetite particles having a number-average particle diameter of 250 nm and a resistivity of $5.1\times10^5$ Ω·cm (intensity of magnetization under 79.6 kA/m: 64 $Am^2/kg$; true specific gravity: 5.2 $g/cm^3$) and fine hematite particles having a number-average particle diameter of 260 nm and a resistivity of $4.9\times10^8$ Ω·cm (non-magnetic; true specific gravity: 5.1 $g/cm^3$) as those used in Carrier A were used without any surface treatment.

| | (by weight) |
|---|---|
| Phenol | 10 parts |
| Formaldehyde solution (aqueous 37% by weight formaldehyde solution) | 6 parts |
| Above fine magnetite particles | 76 parts |
| Above fine hematite particles | 8 parts |
| Calcium fluoride | 1 part |

The above materials, and 5 parts by weight of 28% by weight ammonia water and 10 parts by weight of water were put into a flask, and were thoroughly mixed. At this point, the dissolved oxygen in the reaction medium was 7.2 $g/m^3$. Subsequently, without introducing any nitrogen, the reaction system was heated at an average heating rate of 3.0° C./minute from room temperature to 85° C. with stirring, and was kept at that temperature to carry out polymerization reaction for 3 hours and effect curing. Here, the peripheral speed of the stirring blade was set to 1.8 m/sec. Thereafter, the system was cooled to,30° C., and water was further added thereto. Thereafter, the supernatant liquid was removed, and the precipitate formed was washed with water, followed by air drying. Subsequently, this was dried at a temperature of 60° C. under reduced pressure (5 hPa or less) to obtain magnetic carrier cores (g) having a volume average particle diameter of 35.6 μm, in which the magnetic materials stood dispersed.

The magnetic carrier cores (g) were coated in the same formulation as Carrier A to obtain Carrier G, having a volume-average particle diameter of 35.9 μm, a true specific gravity of 3.59 $g/cm^3$, an intensity of magnetization of 190 $kAm^2/m^3$, a resistivity of $3.5\times10^8$ Ω·cm, an average circularity C of 0.874 and a standard deviation a of 0.076, and containing particles having a value of (average circularity $C-2\sigma$)= 0.722 or less, in a presence percentage of 20.4% by number. The carrier obtained had spherical shape in many particles, but elliptic particles and amorphous particles were mixedly present.

Carrier Production Example H

Fine magnetite particles having a number-average particle diameter of 220 nm were fired at 700° C. for 3 hours in air to obtain fine magnetite particles having a number-average particle diameter of 220 nm and a resistivity of $8.5\times10^7$ Ω·cm (intensity of magnetization under 79.6 kA/m: . . . $Am^2/kg$; true specific gravity: . . . $g/cm^3$). Thereafter, 4.5% by weight of a silane coupling agent 3-(2-aminoethylaminopropyl)trimethoxysilane was added thereto, and these were high-speed mixed and agitated at 120° C. in a container to carry out surface treatment.

| | (by weight) |
|---|---|
| Phenol | 10 parts |
| Formaldehyde solution (aqueous 37% by weight formaldehyde solution) | 6 parts |
| Above treated fine magnetite particles | 84 parts |

The above materials, and 5 parts by weight of 28% by weight ammonia water and 15 parts by weight of water were put into a flask, and were thoroughly mixed. At this point, the dissolved oxygen in the reaction medium was 7.4 $g/m^3$. Subsequently, nitrogen gas was introduced into this reaction medium. The nitrogen gas was introduced at a flow rate of $1.5\times10^{-2}m^3/h$ to effect displacement for 20 minutes. Also, at this point, the dissolved oxygen in the reaction medium was 0.92 $g/m^3$. After that, nitrogen gas was introduced at a flow rate kept low to $0.3\times10^{-2}m^3/h$, where the reaction system was heated at an average heating rate of 3.0° C./minute from room temperature to 85° C. with stirring, and was kept at that temperature to carry out polymerization reaction for 3 hours and effect curing. Here, the peripheral speed of the stirring blade was set to 2.8 m/sec. Thereafter, the system was cooled to 30° C., and water was further added thereto. Thereafter, the supernatant liquid was removed, and the precipitate formed was washed with water, followed by air drying. Subsequently, this was dried at a temperature of 60° C. under reduced pressure (5 hPa or less) to obtain spherical magnetic carrier cores (h) having a volume average particle diameter of 14.2 μm, in which the magnetic materials stood dispersed.

In 50 parts by weight of the same graft copolymer solution (solid content: 33% by weight) as that used in producing Carrier A, 1.0 part by weight of spherical silica particles (number-average particle diameter: 300 nm), 1.5 parts by weight of carbon black (number-average particle diameter: 30 nm; DBP oil absorption: 40 ml/100 g) and 100 parts by weight of toluene were thoroughly mixed by means of a homogenizer to obtain a coating fluid. Subsequently, 1,000 parts by weight of the magnetic carrier cores (h) were agitated under continuous application of shear stress, during which the above coating fluid was slowly added thereto, and then the solvent was evaporated off at 70° C., thus the carrier particle surfaces were coated with the resin. Controlling nitrogen flow rate to be $0.3\times10^{-2}m^3/h$, the magnetic carrier core particles having been coated with the resin were heat-treated at 100° C. for 2 hours, and then cooled, followed by disintegration and then removal of coarse particles with a sieve of 76 μm in mesh opening to obtain Carrier H, having a volume-average particle diameter of 14.4 μm, a true specific gravity of 3.58 $g/cm^3$, an intensity of magnetization of 196 $kAm^2/m^3$, a resistivity of $2.8\times10^9$ Ω·cm, an average circularity C of 0.865 and a standard deviation σ of 0.103, and containing particles having a value of (average circularity $C-2\sigma$)=0.659 or less, in a presence percentage of 7.9% by number. The carrier obtained had elliptic shape in many particles, where those having slender elliptic shape were present, and amorphous particles were present on the fine-powder side.

Carrier Production Example I $Fe_2O_3$, CuO and ZnO were so weighed as to be 52 mol %, 24 mol % and 24 mol %, respectively, in molar ratio, and these were pre-pulverized and mixed for 10 hours using a ball mill. The mixture obtained was calcined at 900° C. for 2 hours, followed by pulverization carried out by means of a ball mill, and further followed by granulation carried out by means of a spray dryer, using polyvinyl alcohol as a binder resin. This was sintered at 1,080° C. for 10 hours, and the sintered product obtained was pulverized and further classified to obtain Cu—Zn ferrite carrier cores (i).

In 20 parts by weight of the same graft copolymer solution (solid content: 33% by weight) as that used in producing Carrier A, 0.5 part by weight of spherical silica particles (number-average particle diameter: 300 nm), 1.0 part by weight of carbon black (number-average particle diameter: 30 nm; DBP oil absorption: 40 ml/100 g) and 100 parts by weight of toluene were thoroughly mixed by means of a homogenizer to obtain a coating fluid. Subsequently, 1,000 parts by weight of the Cu—Zn ferrite carrier cores (i) were agitated under continuous application of shear stress, during which the above coating fluid was slowly added thereto, and then the solvent was evaporated off at 70° C., thus the carrier particle surfaces were coated with the resin. Controlling nitrogen flow rate to be $0.3\times10^{-2}m^3/h$, the magnetic carrier core particles having been coated with the resin were heat-treated at 100° C. for 2 hours, and then cooled, followed by disintegration and then removal of coarse particles with a sieve of 76 μm in mesh opening to obtain Carrier I, having a volume-average particle diameter of 32.3 μm, a true specific gravity of 5.03 $g/cm^3$, an intensity of magnetization of 301 $kAm^2/m^3$, a resistivity of $2.2\times10^9$ Ω·cm, an average circularity C of 0.848 and a standard deviation v of 0.112, and containing particles having a value of (average circularity $C-2\sigma$)=0.624 or less, in a presence percentage of 10.6% by number. The carrier obtained had spherical shape in some particles, but had amorphous shape in many particles, and some agglomerated particles were present. In particular, amorphous particles were present in a large number on the fine-powder side.

Toner Production Example 1

As vinyl copolymer materials, 10 parts by weight of styrene, 5 parts by weight of 2-ethylhexyl acrylate, 2 parts by weight of fumaric acid and 5 parts by weight of a dimer of a-methylstyrene and 5 parts by weight of dicumyl peroxide were put into a dropping funnel. Also, as polyester unit materials, 25 parts by weight of polyoxypropylene(2.2)-2,2-bis(4-hydroxyphenyl)propane, 15 parts by weight of polyoxyethylene(2.2)-2,2-bis(4-hydroxyphenyl)propane, 9 parts by weight of terephthalic acid, 5 parts by weight of trimellitic anhydride, 24 parts by weight of fumaric acid and 0.2 part by weight of tin 2-ethylhexanoate were put into a 4-liter four-necked flask made of glass, and a thermometer, a stirring rod, a condenser and a nitrogen feed tube were attached thereto. This four-necked flask was placed in a mantle heater. Next, the inside atmosphere of the four-necked flask was displaced with nitrogen gas, followed by gradual heating with stirring. With stirring at a temperature of 130° C., the monomers and polymerization initiator for the vinyl resin were dropwise added thereto over a period of 4 hours. Subsequently, the mixture was heated to 200° C. to carry out reaction for about 4 hours to obtain a resin having a weight-average molecular weight of 79,000 and a number-average molecular weight of 3,900.

| | |
|---|---|
| Above resin | 100 parts |
| Purified normal paraffin wax (maximum endothermic peak temperature: 80° C.; Mw: 800; Mn: 600) | 5 parts |
| 3,5-Di-tert-butylsalicylic acid aluminum compound | 0.5 part |
| C.I. Pigment Blue 15:3 | 5 parts |

The above materials were mixed using Henschel mixer (FM-75 Type, manufactured by Mitsui Miike Engineering Corporation). Thereafter, the mixture obtained was kneaded by means of a twin-screw kneader (PCM-30 Type, manufactured by Ikegai Corp.) set to a temperature of 130° C. The kneaded product obtained was cooled, and then crushed by means of a hammer mill to a size of 1 mm or less to obtain a crushed product. The crushed product was then finely pulverized by means of an impact air grinding machine making use of high-pressure air. The finely pulverized product obtained was further subjected to surface modification using the surface modifying apparatus as shown in FIGS. 2 and 3, at a number of dispersing rotor revolutions of 100 $s^{-1}$ (rotational peripheral speed: 130 m/sec) for 45 seconds while removing fine particles at a number of dispersing-rotor revolutions of 120 $s^{-1}$ (after the feeding of the finely pulverized product through the material feed opening 33 was completed, the surface modification was carried out for 45 seconds and then the discharge valve 38 was opened to take out the surface-modified product). In that surface modification, forty rectangular pins were provided on the top of the dispersing rotor 6, and the clearance between the lower end of the guide cylinder 39 and the rectangular pins on the dispersing rotor 36 was set to 30 mm, and the clearance between the dispersing rotor 36 and the liner 34 was set to 3 mm. Also, the air flow of the blower was set to 14 $m^3$/min, and temperature of the refrigerant made to run through the jacket and the cold air temperature T1 were set to −20° C.

With repetition in this state, the apparatus was operated for 20 minutes. As the result, the temperature T2 at the rear of the classifying rotor was stable at 26° C., and cyan particles were obtained which had a weight-average particle diameter of 5.7 μm and an average circularity T of 0.943.

To 100 parts by weight of the cyan particles obtained, 1.0 part by weight of silica particles of 110 nm in maximum peak particle diameter based on number distribution, 0.9 part by weight of titanium oxide particles of 50 nm in maximum peak particle diameter based on number distribution, having a degree of hydrophobicity of 70%, and 0.5 part by weight of silicone oil treated silica particles of 20 nm in maximum peak particle diameter based on number distribution, having a degree of hydrophobicity of 98% were added, and these were mixed using Henschel mixer (FM-75 Type, manufactured by Mitsui Miike Engineering Corporation) to obtain Cyan Toner 1, having a weight-average particle diameter of 5.8 μm and an average circularity T of 0.943.

Toner Production Example 2

In the formulation used in producing Cyan Toner 1, the finely pulverized product was obtained in the same manner as Cyan Toner 1. Further, its surface modification was carried out at a number of revolutions of 125 $s^{-1}$ by means of Hybridizer (manufactured by Nara Machinery Co., Ltd.) to obtain cyan particles having a weight-average particle diameter of 5.2 μm and an average circularity T of 0.934. Compared with those of Cyan Toner 1, the cyan particles obtained contained fine powder in a large quantity, and hence were classified by means of a multi-division classifier utilizing the Coanda effect to obtain cyan particles having a weight-average particle diameter of 5.6 μm and an average circularity T of 0.936.

External addition was carried out in the same manner as Cyan Toner 1 to obtain Cyan Toner 2, having a weight-average particle diameter of 5.6 μm and an average circularity T of 0.935.

Toner Production Example 3

In the formulation used in producing Cyan Toner 1, the finely pulverized product was obtained in the same manner as Cyan Toner 1. The finely pulverized product obtained was classified by means of a multi-division classifier utilizing the Coanda effect to obtain cyan particles having a weight-average particle diameter of 5.5 μm and an average circularity T of 0.915.

External addition was carried out in the same manner as Cyan Toner 1 to obtain Cyan Toner 3, having a weight-average particle diameter of 5.6 μm and an average circularity T of 0.915.

Toner Production Example 4

| | (by weight) |
|---|---|
| Styrene | 86 parts |
| n-Butyl acrylate | 14 parts |
| Acrylic acid | 3 parts |
| Dodecanethiol | 6 parts |
| Carbon tetrabromide | 1 part |

The materials formulated as above were mixed and dissolved to prepare a solution, which was added to a solution prepared by dissolving 1.5 parts by weight of a nonionic surface-active agent (NONIPOL 400, available from Daiichi Kogyo Seiyaku Co., Ltd.) and 2.5 parts by weight of an anionic surface-active agent (NEOGEN SC, available from Daiichi Kogyo Seiyaku Co., Ltd.) in 140 parts by weight of ion-exchanged water. These were dispersed and emulsified in a flask, and 10 parts by weight of ion-exchanged water in which 1 part by weight of ammonium persulfate was dissolved was introduced thereinto with slow mixing for 10 minutes. Then, the inside atmosphere of the system was displaced with nitrogen, and thereafter the contents of the flask were heated using an oil bath with stirring until the contents reached 70° C., where emulsification polymerization was continued for 5 hours as it was, to obtain Resin Particle Dispersion 1, in which resin particles of 0.14 μm in number-average particle diameter stood dispersed.

| | (by weight) |
|---|---|
| Styrene | 75 parts |
| n-Butyl acrylate | 25 parts |
| Acrylic acid | 3 parts |

The materials formulated as above were also mixed and dissolved to prepare a solution, which was added to a solution prepared by dissolving 1.5 parts by weight of a nonionic surface-active agent (NONIPOL 400, available from Daiichi Kogyo Seiyaku Co., Ltd.) and 3.5 parts by weight of an anionic surface-active agent (NEOGEN SC, available from Daiichi Kogyo Seiyaku Co., Ltd.) in 150 parts by weight of ion-exchanged water. These were dispersed and emulsified in a flask, and 10 parts by weight of ion-exchanged water in which 1 part by weight of ammonium persulfate was dissolved was introduced thereinto with slow mixing for 10 minutes. Then, the inside atmosphere of the system was displaced with nitrogen, and thereafter the contents of the flask were heated using an oil bath with stirring until the contents reached 70° C., where emulsification polymerization was continued for 5 hours as it was, to obtain Resin Particle Dispersion 2, in which resin particles of 0.12 μm in number-average particle diameter stood dispersed.

| | (by weight) |
|---|---|
| Purified normal paraffin wax (maximum endothermic peak temperature: 80° C.; Mw: 800; Mn: 600) | 50 parts |
| Anionic surface-active agent (NEOGEN SC, available from Daiichi Kogyo Seiyaku Co., Ltd.) | 5 parts |
| Ion-exchanged water | 200 parts |

The materials formulated as above were further heated to 97° C., and then dispresed by means of a homogenizer (ULTRATALUX T50, manufactured by IKA Japan K.K.), followed by dispersion treatment using a pressure ejection type homogenizer to prepare a release agent dispersion in which a release agent of 0.41 μm in number-average particle diameter stood dispersed.

| | (by weight) |
|---|---|
| C.I. Pigment Blue 15:3 | 12 parts |
| Anionic surface-active agent (NEOGEN SC, available from Daiichi Kogyo Seiyaku Co., Ltd.) | 2.5 parts |
| Ion-exchanged water | 78 parts |

The materials formulated as above were still further mixed, and then put to dispersion treatment using a sand grinder to prepare a colorant dispersion in which a colorant of 0.2 μm in number-average particle diameter stood dispersed.

| | (by weight) |
|---|---|
| Above Resin Particle Dispersion 1 | 150 parts |
| Above Resin Particle Dispersion 2 | 210 parts |
| Above release agent dispersion | 40 parts |
| Above colorant dispersion | 70 parts |

The above were introduced into a 1 liter separable flask fitted with a stirrer, a condenser and a thermometer, and stirred. The pH of the resultant mixed dispersion was adjusted to 5.3 using 1 mol/liter of potassium hydroxide.

To this mixed dispersion, 150 parts by weight of an aqueous 10% sodium chloride solution was dropwise added as an agglomerating agent, and the contents of the flask was heated to 70° C. in a heating oil bath. Keeping this temperature, 3 parts by weight of Resin Particle Dispersion 2 was further added. The mixture obtained was kept at 70° C. for 1 hour, and thereafter 3 parts by weight of an anionic surface-active agent (NEOGEN SC, available from Daiichi Kogyo Seiyaku Co., Ltd.) was added. Thereafter, the flask was sealed and, with stirring continued using a magnetic seal, heated to 90° C., which was kept for 3 hours. Then, after cooling, the reaction product obtained was filtered, and washed sufficiently with ion-exchanged water, followed by drying to obtain cyan particles having a weight-average particle diameter of 4.7 μm and an average circularity T of 0.964.

To 100 parts by weight of the cyan particles obtained, 1.5 parts by weight of silica particles of 90 nm in maximum peak particle diameter based on number distribution and 0.9 part by weight of titanium oxide particles of 40 nm in maximum peak particle diameter based on number distribution, having a degree of hydrophobicity of 70% were added, and these were mixed using Henschel mixer (FM-75 Type, manufactured by Mitsui Miike Engineering Corporation) to obtain Cyan Toner 4, having a weight-average particle diameter of 4.8 μm and an average circularity T of 0.964.

Toner Production Example 5

In 710 parts by weight of ion-exchanged water, 450 parts by weight of an aqueous 0.12 mol/liter $Na_3PO_4$ solution was introduced, followed by heating to 60° C. and then stirring at 11,000 rpm using a TK-type homomixer (manufactured by Tokushu Kika Kogyo Co., Ltd.). To the resultant mixture, 70 parts by weight of an aqueous 1.0 mol/liter CaCl2 solution was slowly added to obtain an aqueous medium containing $Ca_3(PO_4)_2$.

| | (by weight) |
|---|---|
| Styrene | 162 parts |
| n-Butyl acrylate | 38 parts |
| Ester wax (chief component: $CH_3(CH_2)_{20}COO(CH_2)_{21}CH_3$; Mw: 650; Mn: 500; maximum endothermic peak temperature: 72° C.;) | 10 parts |
| 3,5-Di-t-butylsalicylic acid aluminum compound | 5 parts |
| Saturated polyester (a condensation product of propylene oxide bisphenol A with terephthalic acid; acid value: 15 mgKOH/g; peak molecular weight: 6,000) | 10 parts |
| C.I. Pigment Blue 15:3 | 12 parts |

Meanwhile, the above materials were heated to 60° C. and uniformly dissolved or dispersed by means of a TK-type homomixer (manufactured by Tokushu Kika Kogyo Co., Ltd.) at 10,000 rpm. To the mixture obtained, 8 parts by weight of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of nitrogen, using the TK-type homomixer at 11,000 rpm to granulate the polymerizable monomer composition. Thereafter, the granulated product obtained was stirred with a paddle stirring blade during which the temperature was raised to 80° C., where the reaction was carried out for 10 hours. After the polymerization reaction was completed, residual monomers were evaporated off under reduced pressure, the reaction system was cooled, and thereafter hydrochloric acid was added thereto to dissolve the $Ca_3(PO_4)_2$ and so forth, followed by filtration, washing with water and then drying to obtain cyan particles with a weight-average particle diameter of 7.1 μm and an average circularity T of 0.985.

To 100 parts by weight of the cyan particles obtained, 0.5 part by weight of titanium oxide particles of 40 nm in maximum peak particle diameter based on number distribution, having a degree of hydrophobicity of 65% and 0.8 parts by weight of silica particles of 30 nm in maximum peak particle diameter based on number distribution, having a degree of hydrophobicity of 95% were added, and these were mixed using Henschel mixer (FM-75 Type, manufactured by Mitsui Miike Engineering Corporation) to obtain Cyan Toner 5, having a weight-average particle diameter of 7.2 μm and an average circularity T of 0.985.

Toner Production Examples 6 to 8

Toners were produced in the same manner as in Toner Production Example 1 except that the colorant used in Toner Production Example 1 was changed for 8 parts by weight of C.I. Pigment Yellow 74 (Yellow Toner 6), 8 parts by weight of C.I. Pigment Red 122 (Magenta Toner 7) and 6 parts by weight of carbon black PRINTEX 60 (available from Degussa Corp.) (Black Toner 8), respectively. Obtained were Yellow Toner 6, having a weight-average particle diameter of 5.8 μm and an average circularity T of 0.949, Magenta Toner 7, having a weight-average particle diameter of 5.7 μm and an average circularity T of 0.943, and Black Toner 8, having a weight-average particle diameter of 5.9 μm and an average circularity T of 0.946.

Photosensitive Member

Production Example 1

Using as a support an aluminum cylinder (JIS A 3003 aluminum alloy) having a length of 340 mm and a diameter of 84 mm and having been subjected to honing, a 5% by weight methanol solution of a polyamide resin (trade name: AMILAN CM8000; available from Toray Industries, Inc.) was coated by dip coating, followed by drying to form a subbing layer with a layer thickness of 0.5 μm.

Next, as a charge-generating material, 3 parts by weight of crystals of hydroxygallium phthalocyanine having the strongest peak at a Bragg's angle (2θ plus-minus 0.2) of 28.1° in the CuKα characteristic X-ray diffraction and 2 parts by weight of polyvinyl butyral resin were added to 100 parts by weight of cyclohexanone, and these were subjected to dispersion for 1 hour by means of a sand mill making use of glass beads of 1 mm in diameter, followed by addition of 100 parts by weight of methyl ethyl ketone to make dilution to prepare a charge generation layer coating dispersion. This charge generation layer coating dispersion was dip-coated on the above subbing layer, followed by drying at 90° C. for 10 minutes to form a charge generation layer with a layer thickness of 0.17 μm.

Next, 7 parts by weight of a charge-transporting material having a structure represented by the following formula:

Chemical Formula 1

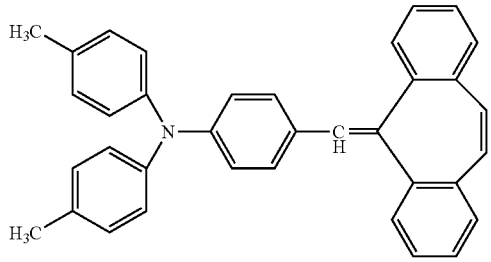

and 10 parts by weight of polycarbonate resin (IUPILON Z400; available from Mitsubishi Engineering-Plastics Corporation) were dissolved in a mixed solvent of 105 parts by weight of monochlorobenzene and 35 parts by weight of dichloromehtane to prepare a charge transport layer coating solution. This charge transport layer coating solution was dip-coated on the above charge generation layer, followed by hot-air drying at 110° C. for 1 hour to form a first charge transport layer with a layer thickness of 12 μm. On the first charge transport layer, a surface layer was further formed as a second charge transport layer.

As the second charge transport layer, a surface layer containing a compound formed by polymerizing a hole-transporting compound represented by the following formula (Chemical Formula 2), having the following polymerizable functional group (2):

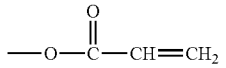

(2)

was formed-by coating and cured in the following way.

Chemical Formula 2

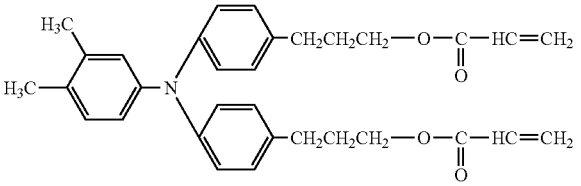

45 parts by weight of this hole-transporting compound was dissolved in 55 parts by weight of n-propyl alcohol, and 5 parts by weight of fine tetrafluoroethylene particles were further added, followed by dispersion using a high-pressure dispersion machine (MICROFLUIDIZER, manufactured by Microfluidics Corporation) to prepare a second charge transport layer coating dispersion. This coating dispersion was coated on the above four-layer photosensitive member, followed by irradiation with electron rays under conditions of an accelerating voltage of 150 kV and a dose of 40 kGy to effect curing to form a second charge transport layer with a layer thickness of 3 μm. Thus, Photosensitive Member 1 was obtained, having a total layer thickness of 15.67 μm. Photosensitive Member 1 was so worked as to be fitted to a color copying machine iRC6800, manufactured by CANON INC. Here, the HU was $1.9\times10^8$ N/m$^2{}_7$ and the modulus of elastic deformation was 54%.

Photosensitive Member

Production Example 2

Photosensitive Member 2, having a total layer thickness of 15.67 μm, was obtained in the same manner as Photosensitive Member 1 except that, in forming the second charge transport layer of Photosensitive Member 1, the surface layer was irradiated with electron rays under conditions of an accelerating voltage of 150 kV and a dose of 20 kGy; the latter being lowered. Here, the HU was $1.6\times10^8$ N/m$^2$, and the modulus of elastic deformation was 51%.

Photosensitive Member

Production Example 3

Photosensitive Member 3, having a total layer thickness of 24.67 μm, was further obtained in the same manner as Photosensitive Member 1 except that the second charge transport layer was-formed using, in place of the hole-transporting compound used when the second charge transport layer of Photosensitive Member 1 was formed, a hole-transporting compound represented by the following Chemical Formula 3, having the following polymerizable functional groups (2) and (4):

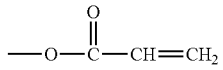

(2)

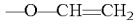

(2)

and that the first charge transport layer and the second charge transport layer were changed to 18 μm and 3 μm, respectively, in layer thickness.

Chemical Formula 3

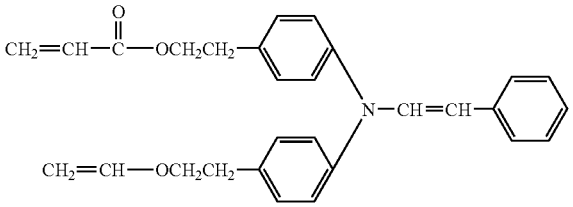

Here, the HU was $1.2\times10^6$ N/m$^2$, and the modulus of elastic deformation was 48%.

Photosensitive Member

Production Example 4

Photosensitive Member 4, having a total layer thickness of 30.67 μm, was obtained in the same manner as Photosensitive Member 3 except that the charge transport layer was formed in a layer thickness of 30 μm and the second charge transport layer was not formed. Here, the HU was $5.6\times10^6$ N/m$^2$, and the modulus of elastic deformation was 36%.

Example 1

To 92 parts by weight of Carrier A, 8 parts by weight of Cyan Toner 1 was added, and these were blended for 2 minutes by means of Turbla mixer to prepare a developer.

The image processing and exposure units of the color copying machine iRC6800, manufactured by CANON INC., were altered so that latent images were able be formed by image-wise exposure. Each developing assembly was also so altered that its developer carrying member was rotatable in the same direction (downward from the top) as the photosensitive member at the developing zone. Also, as a cleaning member, a blade made of polyurethane resin fits hardness (Hs) was measured with a JIS-A spring hardness meter. Hardness: 78 degrees; coefficient of friction: 0.5.) was used, and was so disposed as to come into counter contact with the photosensitive member and so altered as to be slidable in the length-wise direction. The above developer was put into the developing assembly at the cyan position, and images were formed in monochrome using Photosensitive Member 1. Image reproduction was evaluated (initial stage; 100 sheets) in a high-temperature and high-humidity environment H/H (30° C., 80% RH). Thereafter, the copying machine was move to a normal-temperature and low-humidity environment N/L (23.5° C., 10% RH), and left there for 24 hours. Thereafter, image reproduction was evaluated at the initial stage (in 100-sheet reproduction) and after running (extensive operation). As an image sample in the running, a 1%-duty image was used, and images were reproduced on 50,000 sheets. Thereafter, the image evaluation was made. However, when image defects (such as lines and fog) appeared, the running was stopped, where the image evaluation was made.

As developing conditions, the photosensitive member according to the present invention was used, the laser spot diameter was 600 dpi, the developing sleeve and the photosensitive member were made to rotate in the regular direction at the developing zone, and the peripheral speed of the developing sleeve was set 1.5 times that of the photosensitive member. Also, an AC bias of 1.8 kV in Vp-p (peak-to-peak voltage) and 2.0 kHz in frequency was applied to the developing sleeve. Then, a DC bias was applied while changing its applied voltage Vdc so that solid images had a density of about 1.60, and the contrast potential {V1 (light-area potential)−Vdc (applied voltage of DC bias)} was controlled. In that control, the contrast potential was set to 300 V at maximum and, when a contrast potential higher than that was necessary in order to afford the image density of 1.60, images were formed at 300 V. Thereafter, on the basis of the images thus obtained, the following evaluation was made. Items of image reproduction evaluation at the initial stage and after the running and evaluation criteria are shown below.

(1) Image Density and Contrast Width (Initial Stage and After Running):

Image density of fixed images formed when solid toner images are fixed at 170° C. is measured with an X-Rite 500 series instrument (X-Rite 504, manufactured by X-Rite, Inc.).

As to the contrast width, the contrast potential produced when the solid images have the density of about 1.60 is read from the instrument.

(2) Dot Reproducibility:

Halftone images (30H images) are formed, and the images formed are visually observed to make evaluation on dot reproducibility of the images on the basis of the following criteria. Incidentally, the 30H images refer to a halftone image having the 49th gradation counted from the solid white image when the gradations of from solid white to solid black are divided into 256.

A: No feeling of coarseness at all, and images are smooth.

B: Not so feeling of coarseness.

C: There is a feeling of coarseness a little.

D: There is a definite feeling of coarseness.

E: There is a feeling of coarseness very much.

(3) Fog (Initial Stage and After Running):

The average reflectance Dr (%) on plain paper before image reproduction is measured with a reflectometer (REFLECTOMETER MODEL TC-6DS, manufactured by Tokyo Denshoku K.K.). Meanwhile, a solid white image is reproduced on plain paper in the state the Vback is set to 150 V, and then the reflectance Ds (%) of the solid white image is measured. Fog (%) is calculated from the following equation:

$$\text{Fog}(\%)=Dr(\%)-Ds(\%)$$

A: Less than 0.4%.

B: From 0.4% to less than 1.0%.

C: From 1.0% to less than 2.5%.

D: From 2.5% to less than 5.0%.

E: 5.0% or more.

(4) Carrier Adhesion (Initial Stage):

A solid white image is reproduced on plain paper at Vback set to 150 V, and particles are sampled by bringing a transparent pressure-sensitive adhesive tape into close contact with the surface of the photosensitive member (drum) at its part between the developing zone and the cleaner zone. The number of magnetic carrier particles which had adhered to the surface of the photosensitive drum in the area of 1 cm×1 cm is counted to calculate the number of carrier particles having adhered per 1 $cm^2$.

A: Less than 10 particles/$cm^2$.

B: From 10,particles to less than 20 particles/$cm^2$.

C: From 20 particles to less than 50 particles/$cm^2$.

D: From 50 particles to less than 100 particles/$cm^2$.

E: More than 100 particles/$cm^2$.

(5) Drum Lifetime Level (After Running):

The photosensitive member on which 50,000-sheet running has been finished in a normal-temperature and low-humidity environment N/L (23.5° C., 10% RH) is visually evaluated. Also, on the above halftone images, how streaky scratches (in the peripheral direction of the photosensitive member) have appeared is visually evaluated. When image defects have appeared, the running is stopped at that point, where the stated evaluation is made. On that occasion, the evaluation is made on the basis of the number of sheets at the point of time the running is stopped.

A: No scratch appears.

B: Scratches appear to an extent that they are slightly seen when observed carefully.

C: Scratches are seen, but to an extent that they do not affect images.

D: Scratches are clearly seen in visual observation and to an extent that they somewhat affect images.

E: Scratches are clearly seen in visual observation, and image defects appear conspicuously, or image defects appear before the 50,000th-sheet running is finished.

(6) Measurement of Triboelectric Charge Quantity of Toner:

Follow the following procedure in a room controlled to have 23EC and 50% RH.

In each environment, the developer is collected in a container, which is then sealed, followed by mixing for 120 seconds by means of Turbla mixer. Also, as to the triboelectric charge quantity of the toner at the time of running, the developer is sampled from the surface of the developing sleeve by the aid of a magnet and using a plastic bag, and is used without being mixed again.

Then, the triboelectric charge quantity of the toner is measured in the following way, using E-START Analyzer MODEL EST-III, ver. 0.03 (manufactured by Hosokawa Micron Corporation).

The above developer is placed to be held on a two-component feeder (a developer holding stand having a rotating disk with a magnet built therein) attached to E-START Analyzer (manufactured by Hosokawa Micron Corporation). Next, nitrogen gas is sprayed from an air nozzle on the developer held on the two-component feeder by magnetic force, to blow off only the toner, and only the toner is fed by suction into the measuring part of E-START Analyzer through a sample feed tube provided at the lower part of the two-component feeder. On the toner fed into measuring part, its charge quantity q/d (femt-C/μm) corresponding to particle diameter d (μm) is measured. Then, using attached software, the average triboelectric charge quantity q/m of all particles is determined on the basis of the data obtained. Incidentally, conditions for the measurement with E-START Analyzer in the present embodiments are as follows.

Nitrogen gas blow pressure: 20 kPa.

Nitrogen gas blow time: 1 second.

Nitrogen gas blow intervals: 4 seconds.

Applied voltage: 100 V.

Number of particles counted: 3,000 particles.

In this Example, the contrast width at the initial stage in H/H was sufficient. At the initial stage in N/L, the dot reproducibility in halftone images was very good, and also the fog and the carrier adhesion were well prevented. As to the results of 50,000-sheet reproduction in N/L, the image density and the contrast width were satisfactory, showing very good toner release from carrier, and further, good results were obtained also on the dot reproducibility and fog. Any carrier adhesion also did not occur, and also any drum scratches that might be thereby caused did not occur.

The carrier physical properties are shown in Table 1; the toner physical properties, in Table 2; and the test results on developer in Table 3.

Example 2

To 92 parts by weight of Carrier B, 8 parts by weight of Cyan Toner 1 was added, and these were blended-for 2 minutes by means of Turbla mixer to prepare a developer.

Using this developer, tests were conducted in the same manner as in Example 1. As the result, in both H/H and N/L, the image density and the contrast width were sufficient, and also the dot reproducibility was very good, but the carrier adhesion somewhat occurred. During the running, the fog became somewhat worse, but any drum scratches did not occur.

The carrier physical properties are shown in Table 1; the toner physical properties, in Table 2; and the test results on developer in Table 3.

Example 3

To 94 parts by weight of Carrier C, 6 parts by weight of Cyan Toner 1 was added, and these were blended for 2 minutes by means of Turbla mixer to prepare a developer.

Using this developer, tests were conducted in the same manner as in Example 1. As the result, in H/H, the contrast width was somewhat not ensured. In N/L, the dot reproducibility was somewhat inferior. Also, the carrier adhesion did not occur, but, after the running, the drum scratches were seen to have somewhat occurred, and also the fog appeared slightly which was considered due to toner deterioration.

The carrier physical properties are shown in Table 1; the toner physical properties, in Table 2; and the test results on developer in Table 3.

Example 4

To 88 parts by weight of Carrier D, 12 parts by weight of Cyan Toner 1 was added, and these were blended for 2 minutes by means of Turbla mixer to prepare a developer.

Using this developer, tests were conducted in the same manner as in Example 1. As the result, the image density, the contrast width and the dot reproducibility were very good, but the carrier adhesion somewhat occurred during the running. Drum scratches were slightly seen which were considered due to it.

The carrier physical properties are shown in Table 1; the toner physical properties, in Table 2; and the test results on developer in Table 3.

Example 5

To 94 parts by weight of Carrier E, 6 parts by weight of Cyan Toner 1 was added, and these were blended for 2 minutes by means of Turbla mixer to prepare a developer.

Using this developer, tests were conducted in the same manner as in Example 1. As the result, in H/H, the contrast width was sufficient and the image density was also good, but, in N/L, the toner release from carrier was somewhat poor to cause a lowering of developing performance a little. During the running, fog occurred which was considered due to toner deterioration, and on the other hand it was considered that the carrier adhesion came about to have caused drum scratches, but this did not affect images.

The carrier physical properties are shown in Table 1; the toner physical properties, in Table 2; and the test results on developer in Table 3.

Example 6

To 94 parts by weight of Carrier F, 6 parts by weight of Cyan Toner 1 was added, and these were blended for 2 minutes by means of Turbla mixer to prepare a developer.

Using this developer, tests were conducted in the same manner as in Example 1. As the result, in H/H, the contrast width was sufficient and the image density was also good, but, in N/L, the toner release from carrier was somewhat poor to cause a lowering of developing performance a little. During the running, fog occurred which was considered due to toner deterioration, and the contrast width was also insufficient, but this did not affect images. Also, it was considered that the carrier adhesion came about to have caused drum scratches, but this did not affect images.

The carrier physical properties are shown in Table 1; the toner physical properties, in Table 2; and the test results on developer in Table 3.

Comparative Example 1

To 92 parts by weight of Carrier G, 8 parts by weight of Cyan Toner 2 was added, and these were blended for 2 minutes by means of Turbla mixer to prepare a developer.

Using this developer, tests were conducted in the same manner as in Example 1. As the result, in N/L, the contrast width of image density was not ensured, which was considered due to poor toner release from carrier. Also, the carrier adhesion somewhat much occurred, and, during the running, the drum was finely scratched to become inferior in dot reproducibility.

The carrier physical properties are shown in Table 1; the toner physical properties, in Table 2; and the test results on developer in Table 3.

Comparative Example 2

To 84 parts by weight of Carrier H, 16 parts by weight of Cyan Toner 2 was added, and these were blended for 2 minutes by means of Turbla mixer to prepare a developer.

Using this developer, tests were conducted in the same manner as in Example 1. As the result, the image density and the contrast width were sufficient, and the dot reproducibility was also very good. However, the carrier adhesion so much occurred that, in the first half of the running, the drum was finely scratched (the photosensitive member became matte), but did not became matte more than that and the 50,000-sheet running was conductible. However, after the running, the dot reproducibility became inferior because of such fine scratches.

The carrier physical properties are shown in Table 1; the toner physical properties, in Table 2; and the test results on developer in Table 3.

Comparative Example 3

To 94 parts by weight of Carrier I, 6 parts by weight of Cyan Toner 2 was added, and these were blended for 2 minutes by means of Turbla mixer to prepare a developer.

Using this developer, tests were conducted in the same manner as in Example 1. As the result, in H/H, the image density was sufficient, but the charge quantity was so small that the contrast potential was not ensured and that non-uniform sweep marks occurred, also resulting in inferior dot reproducibility. In N/L, the carrier adhesion also a little much occurred to make the surface of the photosensitive member finely scratched and become more scratched with progress of the running. Accordingly, the running was stopped at 33,000th sheet, at the stage of which image evaluation was made to find that fog also occurred seriously.

The carrier physical properties are shown in Table 1; the toner physical properties, in Table 2; and the test results on developer in Table 3.

Example 7

To 94 parts by weight of Carrier E, 6 parts by weight of Cyan Toner 2 was added, and these were blended for 2 minutes by means of Turbla mixer to prepare a developer.

Using this developer, tests were conducted in the same manner as in Example 1. As the result, in H/H, the triboelectric charge quantity was so low as not to ensure the contrast width, also resulting in somewhat inferior dot reproducibility, but there was no problem in practical use. During the running, the photosensitive member was finely scratched, but at a level of no problem in practical use.

The carrier physical properties are shown in Table 1; the toner physical properties, in Table 2; and the test results on developer in Table 3.

Example 8

To 94 parts by weight of Carrier E, 6 parts by weight of Cyan Toner 3 was added, and these were blended for 2 minutes by means of Turbla mixer to prepare a developer.

Using this developer, tests were conducted in the same manner as in Example 1. As the result, in both the H/H environment and the N/L environment, the triboelectric charge quantity was a little so low as not to ensure the contrast width, but at a level adaptable in practical use. During the running, the fog occurred somewhat seriously, and the photosensitive member was also finely scratched to a somewhat large extent, but at a level of no problem in practical use.

The carrier physical properties are shown in Table 1; the toner physical properties, in Table 2; and the test results on developer in Table 3.

Example 9

To 94 parts by weight of Carrier F, 6 parts by weight of Cyan Toner 4 was added, and these were blended for 2 minutes by means of Turbla mixer to prepare a developer.

Using this developer, tests were conducted in the same manner as in Example 1. As the result, in H/H, both the image density and the contrast width were sufficient. In N/L, although the dot reproducibility, the fog and the carrier adhesion showed good results, the toner had so high a triboelectric charge quantity as to result in somewhat inferior toner release from carrier and not to ensure the image density, but at a level of no problem in practical use. During the running, the fog occurred somewhat seriously, but good image formation was performable.

The carrier physical properties are shown in Table 1; the toner physical properties, in Table 2; and the test results on developer in Table 3.

Example 10

To 90 parts by weight of Carrier F, 10 parts by weight of Cyan Toner 5 was added, and these were blended for 2 minutes by means of Turbla mixer to prepare a developer.

Using this developer, tests were conducted in the same manner as in Example 1. As the result, in H/H, the triboelectric charge quantity was somewhat low, but both the image density and the contrast width were sufficient. In N/L, the dot reproducibility was a little inferior to that in Example 1. Also, during the running as well, a little inferior results were obtained on the dot reproducibility and the fog, but image formation was substantially good.

The carrier physical properties are shown in Table 1; the toner physical properties, in Table 2; and the test results on developer in Table 3.

Example 11

To 92 parts by weight of Carrier B, 8 parts by weight of Cyan Toner 1 was added, and these were blended for 2 minutes by means of Turbla mixer to prepare a developer.

Photosensitive Member 1 used in Example 1 was changed for Photosensitive Member 2, and, using the above developer, tests were conducted in the same manner as in Example 1. As the result, in H/H, both the image density and the contrast width were sufficient, and the dot reproducibility was also very good. However, the fog and the carrier adhesion somewhat occurred, but at a level of no problem at all in practical use. During the running, the fog occurred a little seriously, and the photosensitive member was also somewhat seen to have finely been scratched presumably because of the carrier adhesion, but at a level of no problem in practical use.

The carrier physical properties are shown in Table 1; the toner physical properties, in Table 2; and the test results on developer in Table 3.

Example 12

To 92 parts by weight of Carrier B, 8 parts by weight of Cyan Toner 1 was added, and these were blended for 2 minutes by means of Turbla mixer to prepare a developer.

Photosensitive Member 1 used in Example 1 was changed for Photosensitive Member 3, and, using the above developer, tests were conducted in the same manner as in Example 1. As the result, in H/H, the triboelectric charge quantity was sufficient, but a smaller contrast width resulted because of a larger layer thickness of the photosensitive member. The dot reproducibility was also somewhat inferior to that in Example 1. In the evaluation after the 50,000-sheet running, the photosensitive member was seen to have been finely scratched.

The carrier physical properties are shown in Table 1; the toner physical properties, in Table 2; and the test results on developer in Table 3.

Comparative Example 4

To 92 parts by weight of Carrier B, 8 parts by weight of Cyan Toner 2 was added, and these were blended for 2 minutes by means of Turbla mixer to prepare a developer.

Photosensitive Member 1 used in Example 1 was changed for Photosensitive Member 4, and, using the above developer, tests were conducted in the same manner as in Example 1. As the result, in H/H, the contrast potential became extremely small, and images with inferior gradation were obtained. The dot reproducibility was also inferior. These were considered due to the layer thickness of the charge transport layer. Further, during the running, the photosensitive member became finely scratched conspicuously, so that lines were seen also on images on 25,000th sheet. At this point of time, the images were evaluated to fine that the dot reproducibility was also a little inferior.

The carrier physical properties are shown in Table 1; the toner physical properties, in Table 2; and the test results on developer in Table 3.

Comparative Example 5

Carrier B in Comparative Example 4 was changed to Carrier I. To 92 parts by weight of Carrier I, 8 parts by weight of Cyan Toner 2 was added, and these were blended for 2 minutes by means of Turbla mixer to prepare a developer.

Using Photosensitive Member 4 and this developer, tests were conducted in the same manner as in Example 1. As the result, in H/H, the contrast potential became extremely small, and images with inferior gradation were obtained. The dot reproducibility was also inferior, and non-uniform sweep marks still also occurred. These were considered due to the layer thickness of the charge transport layer and the specific gravity and magnetic force of the carrier. Further, during the running, the photosensitive member became finely scratched conspicuously, so that lines were seen also on images on 19,000th sheet. At this point of time, the images were evaluated to fine that the dot reproducibility was very inferior, and fog also occurred seriously. These were considered due to toner deterioration and carrier-spent.

The carrier physical properties are shown in Table 1; the toner physical properties, in Table 2; and the test results on developer in Table 3.

Examples 13 to 15

The toner used in Example 1 was changed for Toner 6 (yellow toner), Toner 7 (magenta toner) and Toner 8 (black toner), respectively. To 8 parts by weight of each toner, 92 parts by weight of Carrier A was added, and these were blended for 2 minutes by means of Turbla mixer to prepare a yellow developer, a magenta developer and a black developer.

Using these developers and using Photosensitive Member 1, examinations were made in the same manner as in Example 1. As the result, both the image density and the dot reproducibility were excellent, and the fog and the carrier adhesion were also well prevented. Also, the contrast width was well ensured, and good image formation was performable. In the running as well, the same good results as those in Example 1 were obtained.

The carrier physical properties are shown in Table 1; the toner physical properties, in Table 2; and the test results on developer in Table 3.

This application claims priority from Japanese Patent Application No. 2004-130279 filed on Apr. 26, 2004, which is hereby incorporated by reference herein.

TABLE 1

| | | | | | | | | Coat layers | | | | | |
|---|---|---|---|---|---|---|---|---|---|---|---|---|---|
| | | | | | | | | | | Fine Particles | | Conductive Particles | |
| Carrier | Volume = average particle diam. (μm) | Intensity of magnetization ($kAm^2/m^3$) | True specific gravity ($g/cm^3$) | Resistivity ($\Omega \cdot cm$) | Average circularity C | Standard deviation σ (no. %) | Particles of (C − 2σ) or less | Coat resin Type | Coat resin Coat level (pbw) | Type | Max. peak particle diam. (nm) | Type | Max. peak particle diam. (nm) |
| A | 35.3 | 191 | 3.63 | $6.2 \times 10^8$ | 0.922 | 0.028 | 2.1 | FRn | 1.0 | CrMl | 230 | CBk | 30 |
| B | 37.2 | 148 | 3.56 | $7.3 \times 10^{11}$ | 0.896 | 0.054 | 5.3 | " | " | " | " | " | " |
| C | 53.2 | 194 | 3.63 | $2.9 \times 10^9$ | 0.902 | 0.053 | 5.8 | " | 0.7 | " | 200 | " | " |
| D | 23.5 | 187 | 3.57 | $4.1 \times 10^9$ | 0.874 | 0.052 | 2.8 | " | 1.7 | Sil | 300 | " | " |
| E | 53.1 | 193 | 3.62 | $9.9 \times 10^8$ | 0.905 | 0.051 | 5.4 | SiRn | 1.0 | " | 280 | — | — |
| F | 53.8 | 191 | 3.60 | $5.2 \times 10^8$ | 0.900 | 0.055 | 6.2 | AcRn | " | CrMl | 230 | CBk | 40 |
| G | 35.9 | 190 | 3.59 | $3.5 \times 10^8$ | 0.874 | 0.076 | 20.4 | FRn | " | " | " | " | 30 |
| H | 14.4 | 196 | 3.58 | $2.8 \times 10^9$ | 0.865 | 0.103 | 7.9 | " | 1.7 | Sil | 300 | " | " |
| I | 32.3 | 301 | 5.03 | $2.2 \times 10^8$ | 0.848 | 0.112 | 10.6 | " | 0.7 | " | " | " | " |

Frn: Fluorine resin;

SiRn: Silicone resin;

AcRn: Acrylic resin

CrMl: Cross-linked melamine;

Sil: Silica;

CBk: Carbon black

TABLE 2

| Toner | Weight average particle diam. (μm) | Average circularity C | Production process | External additives: Fine particles 1 | Max. peak particle diam. (nm) | Fine particles 2 | Max. peak particle diam. (nm) | Fine particles 3 | Max. peak particle diam. (nm) |
|---|---|---|---|---|---|---|---|---|---|
| 1 | 5.8 | 0.943 | After pulverization, mechanical sphering | Silica | 110 | $TiO_2$ | 50 | Silicone oil treated Silica | 20 |
| 2 | 5.6 | 0.935 | After pulverization, mechanical sphering | " | " | " | " | Silicone oil treated Silica | " |
| 3 | 5.6 | 0.915 | Pulverization & classification | " | " | " | " | Silicone oil treated Silica | " |
| 4 | 4.8 | 0.964 | Emulsion polymerization & agglomeration | " | 90 | " | 40 | — | — |
| 5 | 7.2 | 0.985 | Suspension polymerization | — | — | " | " | Silica | 30 |
| 6 | 5.8 | 0.949 | After pulverization, mechanical sphering | Silica | 110 | " | 50 | Silicone oil treated Silica | 20 |
| 7 | 5.7 | 0.943 | After pulverization, mechanical sphering | " | " | " | " | Silicone oil treated Silica | " |
| 8 | 5.9 | 0.946 | After pulverization, mechanical sphering | " | " | " | " | Silicone oil treated Silica | " |

TABLE 3

| | Toner | Carrier | Photosensitive member | Toner concentration (wt. %) | H/H (initial stage): Charge quantity (mc/kg) | Image density | Contrast width (V) |
|---|---|---|---|---|---|---|---|
| Example: | | | | | | | |
| 1 | 1 | A | 1 | 8 | −27.7 | 1.60 | 250 |
| 2 | 1 | B | 1 | 8 | −25.7 | 1.60 | 240 |
| 3 | 1 | C | 1 | 6 | −23.3 | 1.61 | 210 |
| 4 | 1 | D | 1 | 12 | −25.4 | 1.60 | 240 |
| 5 | 1 | E | 1 | 6 | −24.3 | 1.59 | 260 |
| 6 | 1 | F | 1 | 6 | −23.6 | 1.61 | 240 |
| Comparative Example: | | | | | | | |
| 1 | 2 | G | 1 | 8 | −24.8 | 1.59 | 270 |
| 2 | 2 | H | 1 | 14 | −25.8 | 1.60 | 240 |
| 3 | 2 | I | 1 | 6 | −18.9 | 1.60 | 200 |
| Example: | | | | | | | |
| 7 | 2 | E | 1 | 6 | −19.8 | 1.61 | 200 |
| 8 | 3 | E | 1 | 6 | −18.5 | 1.61 | 200 |
| 9 | 4 | F | 1 | 6 | −23.0 | 1.60 | 260 |
| 10 | 5 | F | 1 | 10 | −22.1 | 1.61 | 220 |
| 11 | 1 | B | 2 | 8 | −25.4 | 1.61 | 240 |
| 12 | 1 | B | 3 | 8 | −25.6 | 1.61 | 190 |
| Comparative Example: | | | | | | | |
| 4 | 2 | B | 4 | 8 | −25.2 | 1.62 | 140 |
| 5 | 2 | I | 4 | 8 | −19.7 | 1.60 | 130 |
| Example: | | | | | | | |
| 13 | 6 | A | 1 | 8 | −29.1 | 1.60 | 260 |
| 14 | 7 | A | 1 | 8 | −27.6 | 1.60 | 250 |
| 15 | 8 | A | 1 | 8 | −27.5 | 1.60 | 250 |

TABLE 3-continued

| | N/L (initial stage) | | | | | | N/L (after running) | | | |
|---|---|---|---|---|---|---|---|---|---|---|
| | Charge quantity (mC/kg) | Image density | Contrast width (V) | Dot reproducibility | Fog | Carrier adhesion | Image density | Dot repro-ducibility | Fog | Drum lifetime level |
| Example: | | | | | | | | | | |
| 1 | −36.1 | 1.60 | 290 | A | A(0.1) | A(1) | 1.58 | A | A(0.3) | A |
| 2 | −37.6 | 1.59 | 300 | A | A(0.3) | B(16) | 1.54 | A | B(0.5) | A |
| 3 | 35.0 | 1.59 | 290 | B | B(0.4) | A(0) | 1.54 | B | C(1.7) | B |
| 4 | −36.8 | 1.60 | 290 | A | A(0.3) | C(27) | 1.60 | A | B(0.4) | B |
| 5 | −33.6 | 1.55 | 300 | A | B(0.4) | A(8) | 1.46 | B | C(1.9) | B |
| 6 | −36.6 | 1.51 | 300 | A | A(0.3) | B(12) | 1.44 | B | C(1.6) | B |
| Comparative Example: | | | | | | | | | | |
| 1 | −34.6 | 1.48 | 300 | A | A(0.3) | C(31) | 1.52 | C | C(1.3) | D |
| 2 | −34.3 | 1.61 | 290 | A | B(0.4) | E(110) | 1.56 | C | B(0.9) | E |
| 3 | −31.8 | 1.60 | 290 | C | C(1.1) | D(52) | 1.42 | E | D(2.5) | E(33,000)* |
| Example: | | | | | | | | | | |
| 7 | −27.9 | 1.57 | 270 | B | B(0.6) | A(5) | 1.42 | B | C(2.4) | C |
| 8 | −25.5 | 1.59 | 260 | B | B(0.9) | A(6) | 1.40 | C | C(2.4) | C |
| 9 | −45.6 | 1.52 | 300 | A | A(0.4) | B(15) | 1.42 | B | C(1.2) | B |
| 10 | −32.3 | 1.60 | 300 | B | A(0.3) | B(12) | 1.52 | C | C(1.1) | B |
| 11 | −37.5 | 1.60 | 300 | A | B(0.8) | B(14) | 1.50 | B | C(1.5) | C |
| 12 | −36.2 | 1.61 | 270 | B | A(0.3) | A(9) | 1.52 | C | B(0.8) | D |
| Comparative Example: | | | | | | | | | | |
| 4 | −36.8 | 1.60 | 250 | C | A(0.3) | A(7) | 1.50 | C | B(0.9) | E(25,000)* |
| 5 | −30.5 | 1601 | 230 | D | B(0.6) | A(8) | 1.53 | E | C(1.3) | E(19,000)* |
| Example: | | | | | | | | | | |
| 13 | −37.1 | 1.60 | 300 | A | A(0.2) | A(7) | 1.56 | A | B(0.4) | B |
| 14 | −36.5 | 1.59 | 280 | A | A(0.1) | A(2) | 1.57 | A | A(0.3) | A |
| 15 | −35.8 | 1.61 | 290 | A | A(0.1) | A(4) | 1.57 | A | A(0.3) | A |

*stopped on ( . . . )th sheet

What is claimed is:

1. An image forming method comprising at least:

a step for forming an electrostatic latent image on a photosensitive member having at least a charge generation layer on a conductive support and a charge transport layer on the charge generation layer, and a step for developing the electrostatic latent image by the use of a two-component developer having a toner and a carrier, wherein;

said photosensitive member has a surface having a modulus of elastic deformation of from 46% to 65% and a universal hardness value HU of from $1.5\times10^8$ N/m$^2$ to $2.3\times10^8$ N/m$^2$, and said charge transport layer has a layer thickness of from 8.0 μm to 20.0 μm;

said toner has a weight-average particle diameter D4 of from 3.0 μm to 10.0 μm;

said carrier has a volume-average particle diameter Dv of from 15.0 μm to 60.0 μm and an average circularity C of from 0.870 to 0.940, and contains 20% by number or less of particles having a value of (average circularity C−2σ) or less (σ is standard deviation of carrier circularity).

2. The image forming method according to claim 1, wherein said carrier comprises carrier core surfaces having been coated with a resin, and the resin contains at least a silicone resin or a fluorine resin.

3. The image forming method according to claim 1, wherein said carrier is a magnetic material dispersed resin carrier having a magnetic material and a binder resin, and said carrier has a true specific gravity of from 3.0 g/cm$^3$ to 4.0 g/cm$^3$ and an intensity of magnetization per carrier volume under 79.6 kA/m, of from 80 kAm$^2$/m$^3$ to 250 kAm$^2$/m$^3$ (emu/cm$^3$).

4. The image forming method according to claim 1, wherein said toner has a weight-average particle diameter D4 of from 4.0 μm to 8.0 μm and an average circularity of from 0.920 to 1.000.

5. The image forming method according to claim 1, wherein said charge transport layer has a layer thickness of from 8.0 μm to 16.0 μm.

6. The image forming method according to claim 1, wherein said charge transport layer is divided into a first charge transport layer and a second charge transport layer;

said first charge transport layer being a layer formed of a binder resin in which a charge-transporting material has been dispersed; and said second charge transport layer being a layer which forms a surface layer and being formed of a curable resin obtained by polymerizing a compound having a polymerizable functional group represented by the following structural formula (1):

(1)

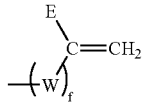

wherein E represents a hydrogen atom, a halogen atom, a substituted or unsubstituted alkyl group, a substituted or unsubstituted aryl group, a cyano group, a nitro group, an alkoxyl group, —$COOR_1$ ($R_1$ represents a hydrogen atom, a halogen atom, a substituted or unsubstituted alkyl group, a substituted or unsubstituted aralkyl group or a substituted or unsubstituted aryl group), —$CONR_2R_3$ ($R_2$ and $R_3$ each represent a hydrogen atom, a halogen atom, a substituted or unsubstituted alkyl group, a substituted or unsubstituted aralkyl group or a substituted or unsubstituted aryl group, and may be the same or different from each other); W represents a substituted or unsubstituted divalent arylene group, a substituted or unsubstituted divalent alkylene group, —COO—, —C—, —O—, —OO—, —S— or —$CONR_4$ ($R_4$ represents a hydrogen atom, a halogen atom, a substituted or unsubstituted alkyl group, a substituted or unsubstituted aralkyl group or a substituted or unsubstituted aryl group); and f represents an integer of 0 or 1.

7. An image forming apparatus which comprises at least a charging assembly, an exposure unit, developing assemblies having developing rollers and two-component developers, a transfer assembly and a photosensitive member having at least a charge generation layer on a conductive support and a charge transport layer on the charge generation layer, and said two-component developer having a toner and a carrier, wherein;

said photosensitive member has a surface having a modulus of elastic deformation of from 46% to 65% and a universal hardness value HU of from $1.5\times10^8$ N/$m^2$ to $2.3\times10^8$ N/$m^2$, and said charge transport layer has a layer thickness of from 8.0 μm to 20.0 μm;

said toner has a weight-average particle diameter D4 of from 3.0 μm to 10.0 μm;

said carrier has a volume-average particle diameter Dv of from 15.0 μm to 60.0 μm and an average circularity C of from 0.870 to 0.940, and contains 20% by number or less of particles having a value of (average circularity C−2σ) or less (σ is standard deviation of carrier circularity).

8. The image forming apparatus according to claim 7, wherein said carrier comprises carrier core surfaces having been coated with a resin, and the resin contains at least a silicone resin or a fluorine resin.

9. The image forming apparatus according to claim 7, wherein said carrier is a magnetic material dispersed resin carrier having a magnetic material and a binder resin, and said carrier has a true specific gravity of from 3.0 g/$cm^3$ to 4.0 g/$cm^3$ and an intensity of magnetization per carrier volume under 79.6 kA/m, of from 80 kA$m^2$/$m^3$ to 250 kA$m^2$/$m^3$ (emu/$cm^3$).

10. The image forming apparatus according to claim 7, wherein said toner has a weight-average particle diameter D4 of from 4.0 μm to 8.0 μm and an average circularity of from 0.920 to 1.000.

11. The image forming apparatus according to claim 7, wherein said charge transport layer has a layer thickness of from 8.0 μm to 16.0 μm.

12. The image forming apparatus according to claim 7, wherein said charge transport layer is divided into a first charge transport layer and a second charge transport layer;

said first charge transport layer being a layer formed of a binder resin in which a charge-transporting material has been dispersed; and said second charge transport layer being a layer which forms a surface layer and being formed of a curable resin obtained by polymerizing a compound having a polymerizable functional group represented by the following structural formula (1):

(1)

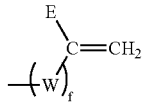

wherein E represents a hydrogen atom, a halogen atom, a substituted or unsubstituted alkyl group, a substituted or unsubstituted aryl group, a cyano group, a nitro group, an alkoxyl group, —$COOR_1$ ($R_1$ represents a hydrogen atom, a halogen atom, a substituted or unsubstituted alkyl group, a substituted or unsubstituted aralkyl group or a substituted or unsubstituted aryl group), —$CONR_2R_3$ ($R_2$ and $R_3$ each represent a hydrogen atom, a halogen atom, a substituted or unsubstituted alkyl group, a substituted or unsubstituted aralkyl group or a substituted or unsubstituted aryl group, and may be the same or different from each other); W represents a substituted or unsubstituted divalent arylene group, a substituted or unsubstituted divalent alkylene group, —COO—, —C—, —O—, —OO—, —S— or —$CONR_4$ ($R_4$ represents a hydrogen atom, a halogen atom, a substituted or unsubstituted alkyl group, a substituted or unsubstituted aralkyl group or a substituted or unsubstituted aryl group); and f represents an integer of 0 or 1.

* * * * *

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

SHEET 2

Figure 2, “15” should read --45--.

COLUMN 1

Line 67, “tried to be formed.” should read --attempted.--.

COLUMN 2

Line 4, “comes” should read --becomes--.

COLUMN 3

Line 7, “also achieve” should read --also to achieve--;
Line 8, “also achieve” should read --also to achieve--;
Line 20, “wherein;” should read --wherein--;
Line 47, “(emu/g.g/$cm^3$=emu/$cm^3$)” should read --(emu/g.g/$cm^3$=emu/$cm^3$).--;
Line 60, “and obtain” should read --and to obtain--; and
Line 61, “an” should read --a--.

COLUMN 4

Line 18, “group), —$CONR_2R_3$” should read --group), or —$CONR_2R_3$--.

COLUMN 5

Line 8, “can not” should read --cannot--.

COLUMN 6

Line 66, “material-P” should read --material P--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 7

Line 43, “can not” should read --cannot--.

COLUMN 8

Line 4, “toner-spent” should read --toner spent--;
Line 31, “preferable-in” should read --preferable in--;
Line 65, “ylstyrenee,” should read --ylstyrene,--; and
Line 66, “p-n-hexystyelene, p-n-octystyrene,” should read --p-n-hexylstyrene, p-n-octylstyrene,--.

COLUMN 9

Line 60, “of-the” should read --of the--.

COLUMN 11

Line 26, “toner-spent.” should read --spent toner.--.

COLUMN 12

Line 14, “erties.,” should read --erties,--.

COLUMN 14

Line 18, “can not” should read --cannot--; and
Line 45, “bring” should read --brings--.

COLUMN 15

Line 23, “casing 15” should read --casing 45--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 16

Line 9, “guided-to” should read --guided to--;
Line 17, “zone”)” should read --zone”).--;
Line 22, “is” should read --are--; and
Line 59, “stearic acid,” should be deleted. (1 occurrence)

COLUMN 18

Line 5, “1, 2, 3, 6, -hexanetetrol,” should read --1, 2, 3, 6, -hexanetriol,--; and
Line 54, “p-n-hexlstyelene,” should read --p-n-hexlstyrene,--.

COLUMN 19

Line 11, “monomer” should read --monomers--; and
Line 37, “acetylyacetone” should read --acetylacetone--.

COLUMN 20

Line 7, “full-color images,” should be deleted;
Line 33, “C.I.,” should read --C.I.--; and
Line 49, “the-colorant” should read --the colorant--.

COLUMN 21

Line 22, “hdyfrochlo-” should read --hydrochlo--;
Line 38, “applied-in” should read --applied in--; and
Line 66, “the,” should read --the--.

COLUMN 22

Line 15, “can not” should read --cannot--; and
Line 25, “than.65%” should read --than 65%--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 24

Line 34, "can not" should read --cannot--.

COLUMN 25

Line 17, "wherein $R^4$ $R^5$" should read --wherein $R^4$, $R^5$--; and "independnetly" should read --independently--.
Line 22, "furfury" should read --furfuryl--;
Line 28, "benzothiophenl" should read --benzothiophenyl--; and
Line 29, "dibenzothiophenl" should read --dibenzothiophenyl--.

COLUMN 27

Line 7, "as" should read --at--;
Line 15, "chlorotrifluoethylene, tetrafluoethylene, hexafluoet-" should read --chlorotrifluoroethylene, tetrafluoroethylene, hexafluoroet- --;
Line 16, "perflupropylene, and perfluoalkyl" should read --perfluoropropylene, and perfluoroalkyl--; and
Line 41, "repeated" should read --repeatedly--.

COLUMN 28

Line 14, "advantages" should read --advantage--;
Line 19, "fro" should read --for--; and
Line 43, "can not" should read --cannot--.

COLUMN 29

Line 21, "less-than" should read --less than--; and
Line 40, "0.3 μm x 0.3 μm) The" should read --0.3 μm x 0.3 μm). ¶ The--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 30

Line 15, “cirtain” should read --certain--;
Line 37, “Layers:” should read --Layers):--; and
Line 45, “form” should read --from--.

COLUMN 31

Line 42, “breads” should read --breadths--.

COLUMN 32

Line 25, “put-into” should read --put into--;
Line 49, “Circularity=(4xArea)/(MaxLengh$_2$x$\pi$).” should read --Circularity = (4 x Area)/(Max Length$_2$ x $\pi$).--;
Line 54, ““MaxLengh”” should read --MaxLength--; and
Line 64, “deviation a” should read --deviation $\sigma$--.

COLUMN 33

Line 2, “These,” should read --Then,--;
Line 9, “out-at” should read --out at--;
Line 11, “breads” should read --breadths--;
Line 33, “breads” should read --breadths--; and
Line 45, “raw-material,” should read --raw material,--.

COLUMN 36

Line 43, “64 $\mu m^2$/” should read --64 $Am^2$/--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 37

Line 16, “deviation v” should read --deviation σ--;
Line 28, “65 $\mu m^2$/” should read --65 $Am^2$/--;
Line 33, “isorpopyltri(N-aminoethyl-aminoethyl)titan” should read --isopropyltri(N-aminoethyl-aminoethyl)titan--; and
Line 60, “to.1.2 m/sec.” should read --to 1.2 m/sec.--.

COLUMN 38

Line 18, “deviation v” should read --deviation σ--.

COLUMN 39

Line 45, “tion a” should read --tion σ--.

COLUMN 40

Line 15, “tion v” should read --tion σ--;
Line 18, “and.” should read --and--; and
Line 62, “deviation v” should read --deviation σ--.

COLUMN 41

Line 34, “to.30°C.,” should read --to 30°C.,--; and
Line 47, “deviation a” should read --deviation σ--.

COLUMN 43

Line 25, “deviation v” should read --deviation σ--; and
Line 38, “a-methylstyrene” should read --α-methylstyrene--.

COLUMN 45

Line 63, “was” should read --were--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 46

Line 16, “dispresed” should read --dispersed--; and
Line 51, “was” should read --were--.

COLUMN 48

Line 64, “dichloromehtane” should read --dichloromethane--.

COLUMN 49

Line 16, “formed-by” should read --formed by--;
Line 44, “1.9 x $10^8$ N/$m^2{}_7$” should read --1.9 x $10^8$ N/$m^2$,--; and
Line 67, “was-formed” should read --was formed--.

COLUMN 50

Line 57, “fits” should read --{its--;
Line 58, “friction: 0.5.)” should read --friction: 0.5.}--; and
Line 67, “move” should read --moved--.

COLUMN 52

Line 10, “10,particles” should read --10 particles--.

COLUMN 53

Line 21, “blended-for” should read --blended for--; and
Line 47, “due to” should read --to be due--.

COLUMN 54

Line 64, “became” should read --become--.

UNITED STATES PATENT AND TRADEMARK OFFICE

CERTIFICATE OF CORRECTION

PATENT NO. : 7,396,629 B2
APPLICATION NO. : 11/114058
DATED : July 8, 2008
INVENTOR(S) : Yoshinobu Baba et al.

It is certified that error appears in the above-identified patent and that said Letters Patent is hereby corrected as shown below:

COLUMN 57

Line 16, “fine” should read --find--.

COLUMN 58

Line 6, “fine” should read --find--; and
Line 8, “carrier-spent.” should read --spent carrier.--.

COLUMN 63

Line 7, “group), —$CONR_2R_3$” should read --group), or —$CONR_2R_3$--.

COLUMN 64

Line 35, “group), —$CONR_2R_3$” should read --group), or —$CONR_2R_3$--.

Signed and Sealed this

Twentieth Day of January, 2009

JON W. DUDAS
*Director of the United States Patent and Trademark Office*